US009848672B2

(12) United States Patent
Podhajny

(10) Patent No.: US 9,848,672 B2
(45) Date of Patent: Dec. 26, 2017

(54) ARTICLE OF FOOTWEAR INCORPORATING A KNITTED COMPONENT WITH INTEGRALLY KNIT CONTOURED PORTION

(71) Applicant: NIKE, Inc., Beaverton, OR (US)

(72) Inventor: Daniel A. Podhajny, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 536 days.

(21) Appl. No.: 13/783,900

(22) Filed: Mar. 4, 2013

(65) Prior Publication Data

US 2014/0245634 A1 Sep. 4, 2014

(51) Int. Cl.

| | |
|---|---|
| ***A43B 1/04*** | (2006.01) |
| ***A43B 23/02*** | (2006.01) |
| ***A43B 23/26*** | (2006.01) |
| ***A43B 23/04*** | (2006.01) |
| ***D04B 1/22*** | (2006.01) |

(52) U.S. Cl.

CPC ..... *A43B 23/0245* (2013.01); *A43B 1/04* (2013.01); *A43B 23/025* (2013.01); *A43B 23/0235* (2013.01); *A43B 23/0265* (2013.01); *A43B 23/0275* (2013.01); *A43B 23/042* (2013.01); *A43B 23/26* (2013.01); *D04B 1/22* (2013.01); *D10B 2403/032* (2013.01); *D10B 2501/043* (2013.01)

(58) Field of Classification Search

CPC ..... A43B 1/04; A43B 23/0235; A43B 3/0036; A43B 23/00; A43B 23/0205; A43B 23/0245; A43B 23/042; A43B 23/26

USPC ..... 36/84, 45, 48, 47, 54

See application file for complete search history.

(56) References Cited

U.S. PATENT DOCUMENTS

| | | | |
|---|---|---|---|
| 336,913 | A | 3/1886 | Graff |
| 601,192 | A | 3/1898 | Woodside |
| 1,215,198 | A | 2/1917 | Joseph |
| 1,359,377 | A | 11/1920 | Hollenbeck |
| 1,597,934 | A | 8/1926 | Stimpson |
| 1,888,172 | A | 11/1932 | Joha |
| 1,902,780 | A | 3/1933 | Holden et al. |

(Continued)

FOREIGN PATENT DOCUMENTS

| | | | |
|---|---|---|---|
| CN | 1925763 | A | 3/2007 |
| CN | 101557733 | A | 10/2009 |

(Continued)

OTHER PUBLICATIONS

Letter from Bruce Huffa dated Dec. 23, 2013 (71 Pages).

(Continued)

*Primary Examiner* — Marie Bays

(74) *Attorney, Agent, or Firm* — Brinks Gilson & Lione

(57) ABSTRACT

An upper for an article of footwear includes a knitted component having unitary knit construction. The knitted component has a base portion configured to be disposed adjacent the sole structure. The knitted component also includes one or more side portions that extend from the base portion. Furthermore, the knitted component can have at least a first edge and a second edge that are joined at a seam to define a void that receives a foot. Additionally, the upper can include a tensile strand that extends through a passage defined between an exterior surface and an interior surface of the base portion.

20 Claims, 19 Drawing Sheets

(56) References Cited

U.S. PATENT DOCUMENTS 1,910,251 A 5/1933 Joha
2,001,293 A 5/1935 Wilson
2,047,724 A 7/1936 Zuckerman
2,147,197 A 2/1939 Glidden
2,314,098 A 3/1943 McDonald
2,330,199 A 9/1943 Basch
2,343,390 A 3/1944 Ushakoff
2,400,692 A 5/1946 Herbert
2,440,393 A 4/1948 Clark
2,494,617 A 1/1950 Hogan
2,495,984 A 1/1950 Roy
2,569,764 A 10/1951 Jonas
2,586,045 A 2/1952 Hoza
2,608,078 A 8/1952 Anderson
2,641,004 A 6/1953 Whiting et al.
2,654,965 A * 10/1953 Sloan ..... A43B 3/30 36/45
2,675,631 A 4/1954 Doughty
2,974,427 A 3/1961 Wolff
2,994,322 A 6/1961 Cullen et al.
3,289,330 A * 12/1966 Trachsel ..... A43B 3/14 12/142 MC
3,378,940 A * 4/1968 Potvin, Jr. ..... A43B 3/14 36/11
3,583,081 A 6/1971 Hayashi
3,618,235 A * 11/1971 Cary ..... A43C 11/1493 36/50.1
3,694,940 A 10/1972 Rudolf
3,704,474 A 12/1972 Julius
3,766,566 A 10/1973 Tadokoro
3,778,856 A 12/1973 Christie et al.
3,952,427 A 4/1976 Von Den Benken et al.
3,972,086 A 8/1976 Belli et al.
4,027,402 A 6/1977 Liu et al.
4,031,586 A 6/1977 Von Den Benken et al.
4,211,806 A 7/1980 Civardi et al.
4,232,458 A 11/1980 Bartels
4,255,949 A 3/1981 Thorneburg
4,258,480 A 3/1981 Famolare, Jr.
4,317,292 A 3/1982 Melton
4,373,361 A 2/1983 Thorneburg
4,447,967 A * 5/1984 Zaino ..... A43B 23/0235 36/45
4,465,448 A 8/1984 Aldridge
4,592,154 A 6/1986 Oatman
4,607,439 A 8/1986 Harada
4,654,985 A 4/1987 Chalmers
4,737,396 A 4/1988 Kamat
4,750,339 A 6/1988 Simpson et al.
4,756,098 A 7/1988 Boggia
4,785,558 A 11/1988 Shiomura
4,811,503 A 3/1989 Iwama
4,813,158 A 3/1989 Brown
5,031,423 A 7/1991 Ikenaga
5,095,720 A 3/1992 Tibbals, Jr.
5,117,567 A 6/1992 Berger
5,152,025 A 10/1992 Hirmas
5,192,601 A 3/1993 Neisler
5,291,671 A 3/1994 Caberlotto et al.
5,345,638 A * 9/1994 Nishida ..... A41H 3/08 12/146 C
5,353,524 A 10/1994 Brier
5,371,957 A 12/1994 Gaudio
5,461,884 A 10/1995 McCartney et al.
5,511,323 A 4/1996 Dahlgren
5,572,860 A 11/1996 Mitsumoto et al.
5,575,090 A 11/1996 Condini
5,604,997 A * 2/1997 Dieter ..... A43B 23/042 12/146 C
5,623,840 A 4/1997 Roell
5,678,329 A 10/1997 Griffin et al.
5,692,319 A 12/1997 Parker et al.
5,729,918 A 3/1998 Smets
5,735,145 A 4/1998 Pernick
5,746,013 A 5/1998 Fay, Sr.
5,755,044 A 5/1998 Veylupek
5,765,296 A 6/1998 Ludemann et al.
5,884,419 A 3/1999 Davidowitz et al.
5,996,189 A 12/1999 Wang
6,029,376 A 2/2000 Cass
6,032,387 A 3/2000 Johnson
6,052,921 A 4/2000 Oreck
6,088,936 A 7/2000 Bahl
6,151,802 A 11/2000 Reynolds
6,170,175 B1 1/2001 Funk
6,286,233 B1 9/2001 Gaither
6,308,438 B1 10/2001 Throneburg et al.
6,333,105 B1 12/2001 Tanaka et al.
6,378,230 B1 4/2002 Rotem et al.
6,401,364 B1 6/2002 Burt
6,558,784 B1 5/2003 Norton et al.
6,588,237 B2 7/2003 Cole et al.
6,598,322 B2 7/2003 Jacques et al.
6,754,983 B2 6/2004 Hatfield et al.
6,772,541 B1 8/2004 Ritter
6,910,288 B2 6/2005 Dua
6,922,917 B2 8/2005 Kerns et al.
6,931,762 B1 8/2005 Dua
D517,297 S 3/2006 Jones et al.
7,051,460 B2 5/2006 Orei et al.
7,056,402 B2 6/2006 Koerwien et al.
7,134,224 B2 11/2006 Elkington et al.
D553,842 S 10/2007 Paz
7,343,701 B2 3/2008 Pare et al.
7,347,011 B2 3/2008 Dua et al.
7,441,348 B1 10/2008 Dawson
7,543,397 B2 6/2009 Kilgore et al.
7,562,470 B2 7/2009 Keen
7,568,298 B2 8/2009 Kerns
7,631,440 B2 12/2009 Keen et al.
7,682,219 B2 3/2010 Falla
7,793,435 B1 9/2010 Ruth
8,006,410 B2 8/2011 Romboli et al.
8,074,379 B2 12/2011 Robinson et al.
8,151,490 B2 4/2012 Sokolowski
8,230,618 B2 7/2012 Bruce et al.
8,434,245 B2 * 5/2013 Bell ..... A43B 1/0081 36/105
8,490,299 B2 7/2013 Dua et al.
2002/0078599 A1 6/2002 Delgorgue
2002/0148258 A1 10/2002 Cole et al.
2003/0126762 A1 7/2003 Tseng
2003/0191427 A1 10/2003 Jay et al.
2004/0118018 A1 6/2004 Dua
2004/0181972 A1 9/2004 Csorba
2005/0115284 A1 6/2005 Dua
2005/0193592 A1 * 9/2005 Dua ..... A43B 1/04 36/45
2005/0273988 A1 12/2005 Christy
2005/0284000 A1 * 12/2005 Kerns ..... A43B 1/04 36/45
2006/0048413 A1 * 3/2006 Sokolowski ..... A43B 23/0235 36/45
2006/0059715 A1 3/2006 Aveni
2006/0162187 A1 7/2006 Byrnes et al.
2007/0022627 A1 2/2007 Sokolowski et al.
2007/0180730 A1 8/2007 Greene et al.
2008/0017294 A1 1/2008 Bailey et al.
2008/0078102 A1 4/2008 Kilgore et al.
2008/0110048 A1 * 5/2008 Dua ..... A43B 1/04 36/45
2008/0110049 A1 * 5/2008 Sokolowski ..... A43B 3/0031 36/50.1
2008/0189830 A1 8/2008 Egglesfield
2008/0229617 A1 9/2008 Johnson et al.
2008/0313939 A1 12/2008 Ardill
2009/0068908 A1 3/2009 Hinchcliff
2009/0126231 A1 5/2009 Malmivaara
2010/0051132 A1 3/2010 Glenn
2010/0077634 A1 4/2010 Bell
2010/0154256 A1 * 6/2010 Dua ..... A43B 1/04 36/25 R
2010/0170651 A1 7/2010 Scherb et al.

(56) References Cited

U.S. PATENT DOCUMENTS

| | | | | |
|---|---|---|---|---|
| 2011/0030244 | A1 | 2/2011 | Motawi et al. | |
| 2011/0078921 | A1 | 4/2011 | Greene et al. | |
| 2011/0197475 | A1 | 8/2011 | Weidl et al. | |
| 2011/0258876 | A1 | 10/2011 | Baker et al. | |
| 2012/0023686 | A1 | 2/2012 | Huffa et al. | |
| 2012/0023778 | A1* | 2/2012 | Dojan | A43B 23/0275 36/58.5 |
| 2012/0131818 | A1 | 5/2012 | Nishiwaki et al. | |
| 2012/0198727 | A1* | 8/2012 | Long | A43B 23/0235 36/25 R |
| 2012/0233882 | A1* | 9/2012 | Huffa | A43B 1/04 36/45 |
| 2012/0240428 | A1 | 9/2012 | Knoll | |
| 2012/0255201 | A1 | 10/2012 | Little | |
| 2012/0260526 | A1 | 10/2012 | Smith et al. | |
| 2013/0047467 | A1 | 2/2013 | Roether et al. | |
| 2013/0145652 | A1 | 6/2013 | Podhajny et al. | |

FOREIGN PATENT DOCUMENTS

| | | | |
|---|---|---|---|
| CN | 101562999 | A | 10/2009 |
| CN | 102137600 | A | 7/2011 |
| CN | 102271548 | A | 12/2011 |
| CN | 202335387 | | 7/2012 |
| CN | 202697860 | U | 1/2013 |
| DE | 870963 | C | 3/1953 |
| DE | 1084173 | | 6/1960 |
| DE | 4016217 | A1 | 11/1991 |
| DE | 19738433 | | 4/1998 |
| DE | 19728848 | | 1/1999 |
| EP | 0279950 | A2 | 6/1988 |
| EP | 0448714 | | 10/1991 |
| EP | 0728860 | | 8/1996 |
| EP | 0758693 | | 2/1997 |
| EP | 0898002 | A2 | 2/1999 |
| EP | 1233091 | | 8/2002 |
| EP | 1437057 | A1 | 7/2004 |
| EP | 1563752 | A1 | 8/2005 |
| EP | 1602762 | A1 | 12/2005 |
| EP | 1972706 | A1 | 9/2008 |
| FR | 2171172 | | 9/1973 |
| FR | 2697727 | | 10/1993 |
| GB | 538865 | | 8/1941 |
| GB | 1539886 | | 2/1979 |
| GB | 2018837 | A | 10/1979 |
| GB | 1603487 | | 11/1981 |
| JP | S63-027109 | U | 2/1988 |
| JP | H06113905 | | 4/1994 |
| JP | H08109553 | | 4/1996 |
| JP | 09065908 | | 3/1997 |
| JP | H09-509594 | A | 9/1997 |
| JP | H11302943 | | 11/1999 |
| JP | 2007190351 | | 8/2007 |
| JP | 2010-508968 | A | 3/2010 |
| JP | 2010-508994 | A | 3/2010 |
| JP | 2012-512698 | A | 6/2012 |
| JP | 2012-533404 | A | 12/2012 |
| NL | 7304678 | | 10/1974 |
| WO | 9003744 | | 4/1990 |
| WO | 9222223 | A1 | 12/1992 |
| WO | WO 95/22917 | A1 | 8/1995 |
| WO | 0032861 | | 6/2000 |
| WO | 0231247 | | 4/2002 |
| WO | WO 2008/060928 | A1 | 5/2008 |
| WO | WO 2008/063385 | A1 | 5/2008 |
| WO | WO 2010/080182 | A1 | 7/2010 |
| WO | WO 2011/011176 | A2 | 1/2011 |
| WO | WO 2013/005125 | A1 | 1/2013 |
| WO | 2014137826 | A1 | 9/2014 |

OTHER PUBLICATIONS

International Search Report and Written Opinion in connection with International Application No. PCT/US2014/019542, dated Jun. 26, 2014.

International Search Report and Written Opinion in connection with International Application No. PCT/US2014/019548, dated Jun. 26, 2014.

Declaration of Dr. Edward C. Frederick from the US Patent and Trademark Office Inter Partes Review of U.S. Pat. No. 7,347,011 (178 pp).

David J. Spencer, Knitting Technology: A Comprehensive Handbook and Practical Guide (Third ed., Woodhead Publishing Ltd. 2001) (413 pp).

Excerpt of Hannelore Eberle et al., Clothing Technology (Third English ed., Beuth-Verlag GmnH 2002) (book cover and back; pp. 2-3, 83).

Eberle, et al., Excerpt of Hannelore, Clothing Technology, 3rd edition, Third English ed, Beuth-Verlag GmnH, 2002, pp. 2-3, 83.

International Preliminary Report on Patentability for Application No. PCT/US2012/028534, dated Sep. 17, 2013.

International Preliminary Report on Patentability for Application No. PCT/US2012/028576, dated Sep. 17, 2013.

International Search Report and Written Opinion for Application No. PCT/US2009/056795, dated Apr. 20, 2010.

International Search Report and Written Opinion for Application No. PCT/US2012/028534, dated Oct. 17, 2012.

International Search Report and Written Opinion for Application No. PCT/US2012/026575, dated Oct. 1, 2012.

International Search Report and Written Opinion for Application No. PCT/US2014/047926, dated Nov. 24, 2014.

International Search Report and Written Opinion in connection with PCT/US2012/028559 dated Oct. 19, 2012.

Office Action and English translation from corresponding Chinese Application No. 2014800251722 dated Jun. 28, 2016, 27 pages.

Office Action ad English translation from corresponding ROC (Taiwan Application No. 103129749 dated Jan. 6, 2016, 32 pages.

Office Action and English translation of corresponding Korean Application No. 10-2015-7027323 dated Jan. 26, 2017, 15 pages.

Office Action and English translation of relevant portions from corresponding Chinese Application No. 2014800501516 dated Nov. 23, 2016, 28 pages.

Office Action and English translation of Chinese Application No. 2014800501516 dated Jul. 24, 2017, 29 pages.

Office Action and English translation of Japanese Patent Application No. 2016-541965 dated Jul. 6, 2017, 8 pages.

Office Action and English translation of Korean Application No. 10-2015-7027323, dated Jul. 28, 2017, 15 pages.

Office Action and English translation of Korean Application No. 10-2016-7009464, dated Aug. 11, 2017, 11 pages.

Office Action and English translation of relevant portion for corresponding Chinese Application No. 2014800251722, dated Mar. 15, 2017, 6 pages.

Examination Report for EP Application No. 14722000.8, dated Oct. 10, 2017, 6 pages.

Office Action and English translation of Japanese Application No. 2015-561475, dated Sep. 21, 2017, 12 pages.

* cited by examiner

ARTICLE OF FOOTWEAR INCORPORATING A KNITTED COMPONENT WITH INTEGRALLY KNIT CONTOURED PORTION

FIELD

The present disclosure relates to an article of footwear and, more particularly, relates to an article of footwear incorporating a knitted component with an integrally knit contoured portion.

BACKGROUND

This section provides background information related to the present disclosure which is not necessarily prior art.

Conventional articles of footwear generally include two primary elements, an upper and a sole structure. The upper is secured to the sole structure and forms a void on the interior of the footwear for comfortably and securely receiving a foot. The sole structure is secured to a lower area of the upper, thereby being positioned between the upper and the ground. In athletic footwear, for example, the sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

The upper generally extends over the instep and toe areas of the foot, along the medial and lateral sides of the foot and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

A variety of material elements (e.g., textiles, polymer foam, polymer sheets, leather, synthetic leather) are conventionally utilized in manufacturing the upper. In athletic footwear, for example, the upper may have multiple layers that each includes a variety of joined material elements. As examples, the material elements may be selected to impart stretch-resistance, wear-resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas. As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and numbers of material elements. By decreasing the number of material elements utilized in the upper, therefore, waste may be decreased while increasing the manufacturing efficiency and recyclability of the upper.

SUMMARY

This section provides a general summary of the disclosure, and is not a comprehensive disclosure of its full scope or all of its features.

An upper for an article of footwear that is configured to be connected to a sole structure and configured to receive a foot is disclosed. The upper includes a knitted component having unitary knit construction. The knitted component has a base portion configured to be disposed adjacent the sole structure. The knitted component also includes a heel portion and a forefoot portion that extend from opposite ends of the base portion. Furthermore, the knitted component includes a medial portion and a lateral portion that extend from opposite sides of the base portion. The medial and lateral portion cooperates to define a throat area between the medial and lateral portions. Furthermore, the knitted component includes a tongue portion that is configured to be disposed in the throat area. The tongue portion is decoupled from at least one of the medial portion and the lateral portion. Moreover, the upper includes a first edge of the knitted component and a second edge of the knitted component. The second edge is configured to be coupled to the first edge at a seam causing the base portion, the heel portion, the forefoot portion, the medial portion, and the lateral portion to cooperatively define a void that is configured to receive the foot.

Additionally, a method of manufacturing a knitted component for an article of footwear that is configured to be connected to a sole structure is disclosed. The method includes knitting the knitted component to have a base portion configured to be disposed adjacent the sole, a heel portion and a forefoot portion that extend from opposite ends of the base portion, and a medial portion and a lateral portion that extend from opposite sides of the base portion. The medial and lateral portion cooperate to define a throat area between the medial and lateral portions. Furthermore, knitting the knitted component includes knitting a tongue portion that is configured to be disposed in the throat area. The tongue portion is decoupled from at least one of the medial portion and the lateral portion. Furthermore, the method includes coupling a first edge of the knitted component and a second edge of the knitted component at a seam causing the base portion, the heel portion, the forefoot portion, the medial portion, and the lateral portion to cooperatively define a void that is configured to receive the foot.

Still further, an upper for an article of footwear that is configured to be connected to a sole structure and that is configured to receive a foot is disclosed. The upper includes a knitted component having a base portion that is configured to be disposed adjacent the sole structure. The base portion defines an interior surface and an exterior surface of the knitted component. The base portion defines a base portion passage between the interior surface and the exterior surface.

Moreover, the upper includes a tensile strand that extends through the base portion passage.

Furthermore, a method of manufacturing an upper that is configured to be connected to a sole structure and that is configured to be worn on a foot is disclosed. The method includes knitting a knitted component having a base portion that is configured to be disposed adjacent the sole structure. The base portion defines an interior surface and an exterior surface of the knitted component. The base portion defines a base portion passage between the interior surface and the exterior surface. The method additionally includes extending a tensile strand through the base portion passage.

Additionally, an article of footwear is disclosed that includes a sole structure and an upper. The upper includes a knitted component having unitary knit construction. The knitted component also includes a base portion that is configured to be disposed adjacent the sole structure. The base portion defines an interior surface and an exterior surface of the knitted component. The base portion also defines a base portion passage between the interior surface and the exterior surface. Furthermore, the article of footwear includes a tensile strand that extends through the base portion passage.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 5:
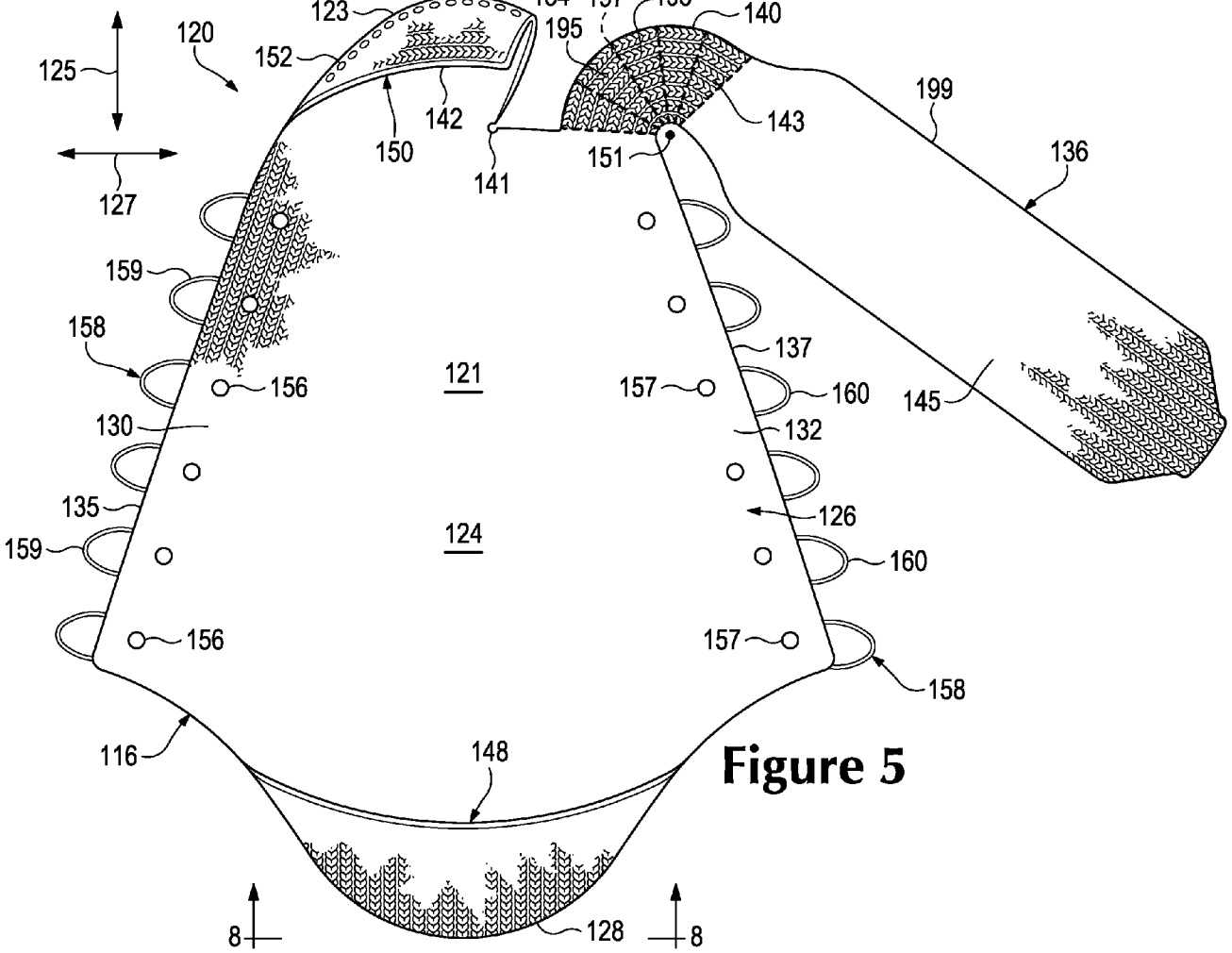
FIG. 5 is a top plan view of the knitted component of FIG. 4.
Figure 8:
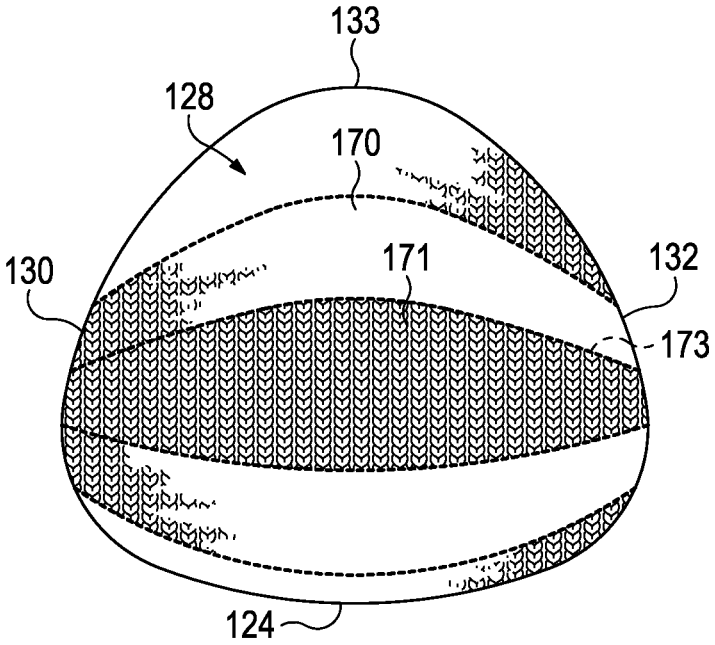
Figure 9:
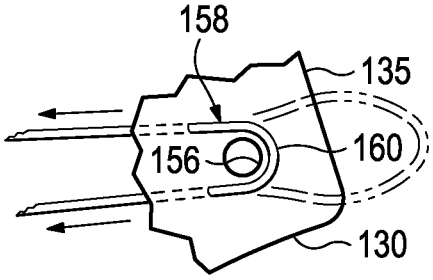

FIG. 8 a schematic view of a heel portion of the knitted component taken from the perspective of the line 8-8 of FIG. 5;

FIG. 9 is a detail view of a portion of the knitted component taken from

Figure 11:
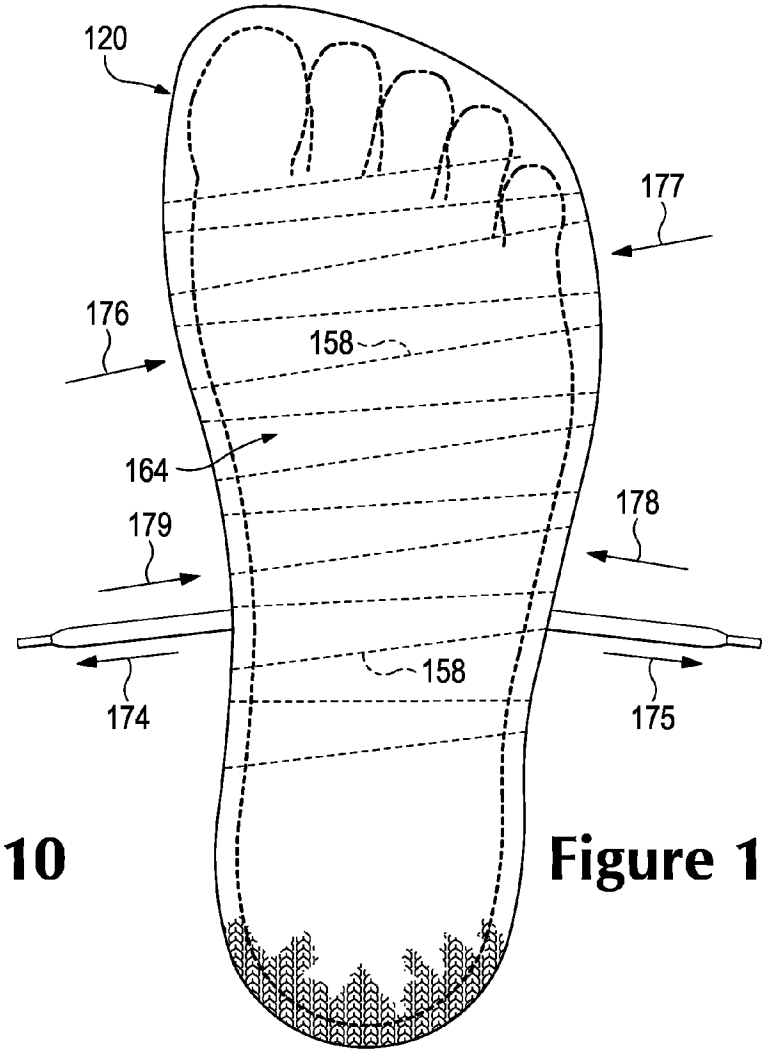
Figure 10:
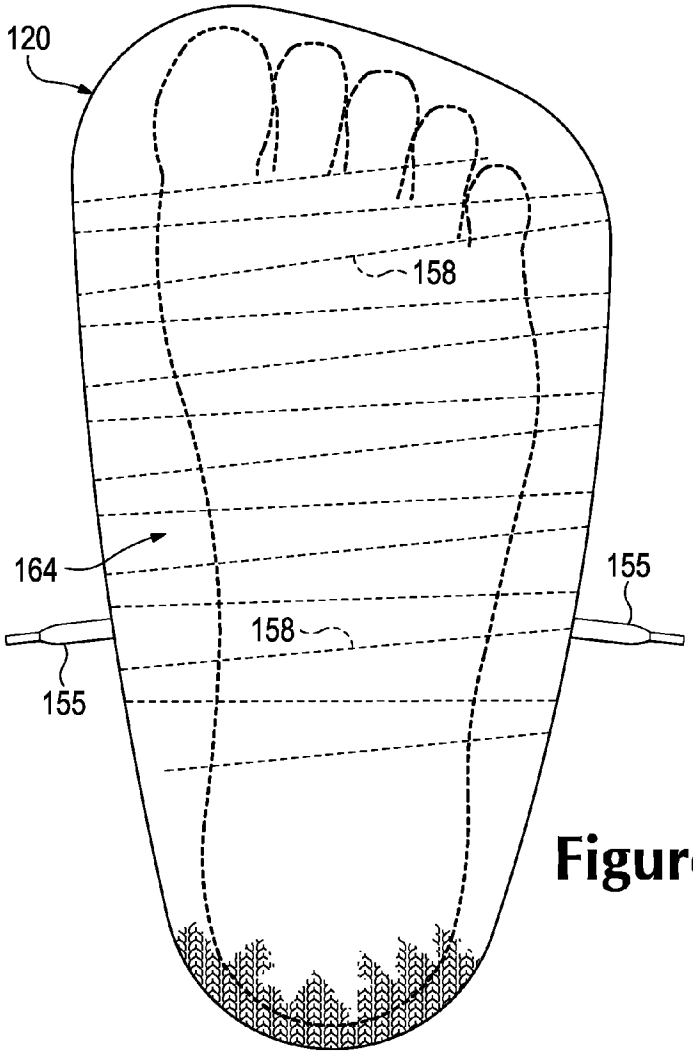
Figure 12:
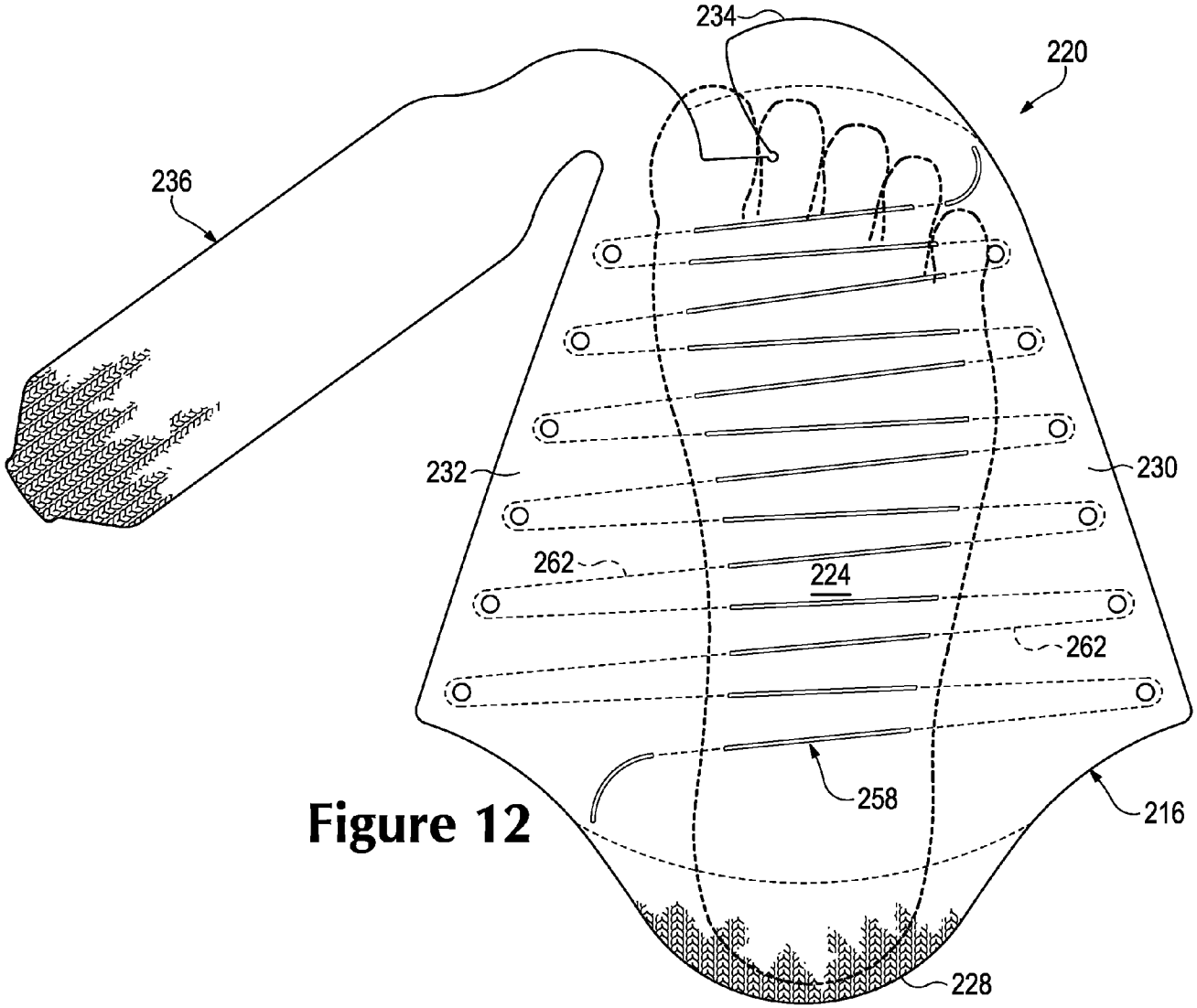
Figure 13:
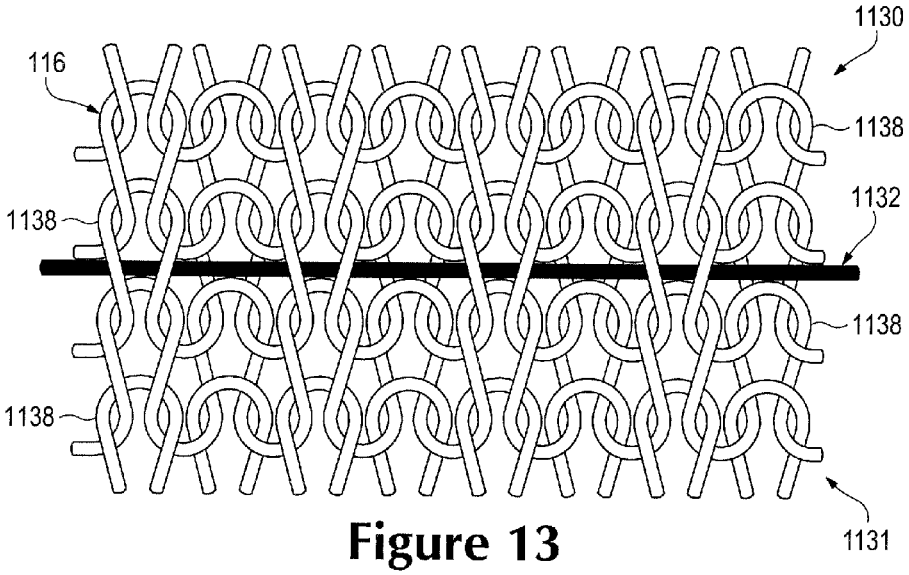
Figure 14:
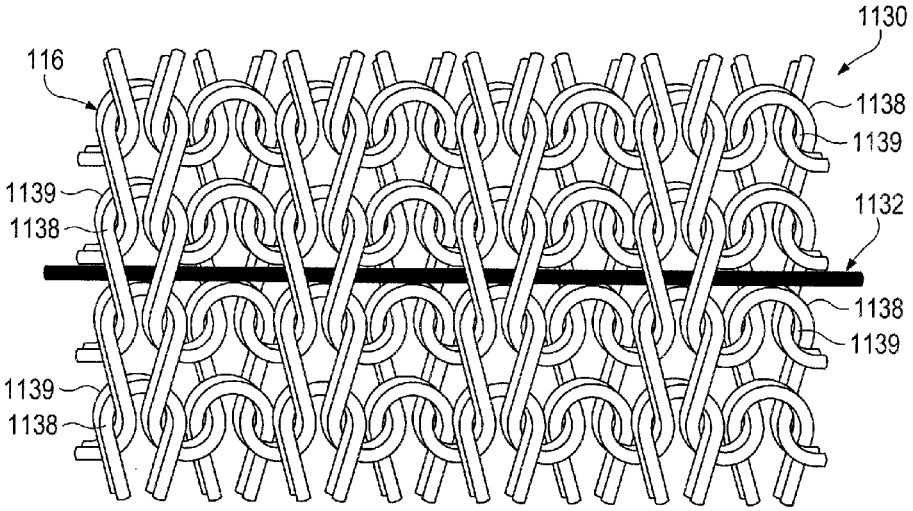

FIG. 6;

FIGS. 10 and 11 are bottom plan views of the knitted component, wherein FIG. 10 shows the closure member in the unsecured position and FIG. 11 shows the closure member in the secured position;

FIG. 12 is a bottom view of a knitted component with inlaid strands according to additional embodiments of the present disclosure;

FIGS. 13 and 14 are schematic views of a unitary knit construction with inlaid strands; and FIGS. 15-23 are perspective schematic views of parts of a flat knitting machine shown during formation of a unitary knit construction with an inlaid strand.

Corresponding reference numerals indicate corresponding parts throughout the several views of the drawings.

DETAILED DESCRIPTION

Example embodiments will now be described more fully with reference to the accompanying drawings.

General Discussion of Article of Footwear

Figure 1:
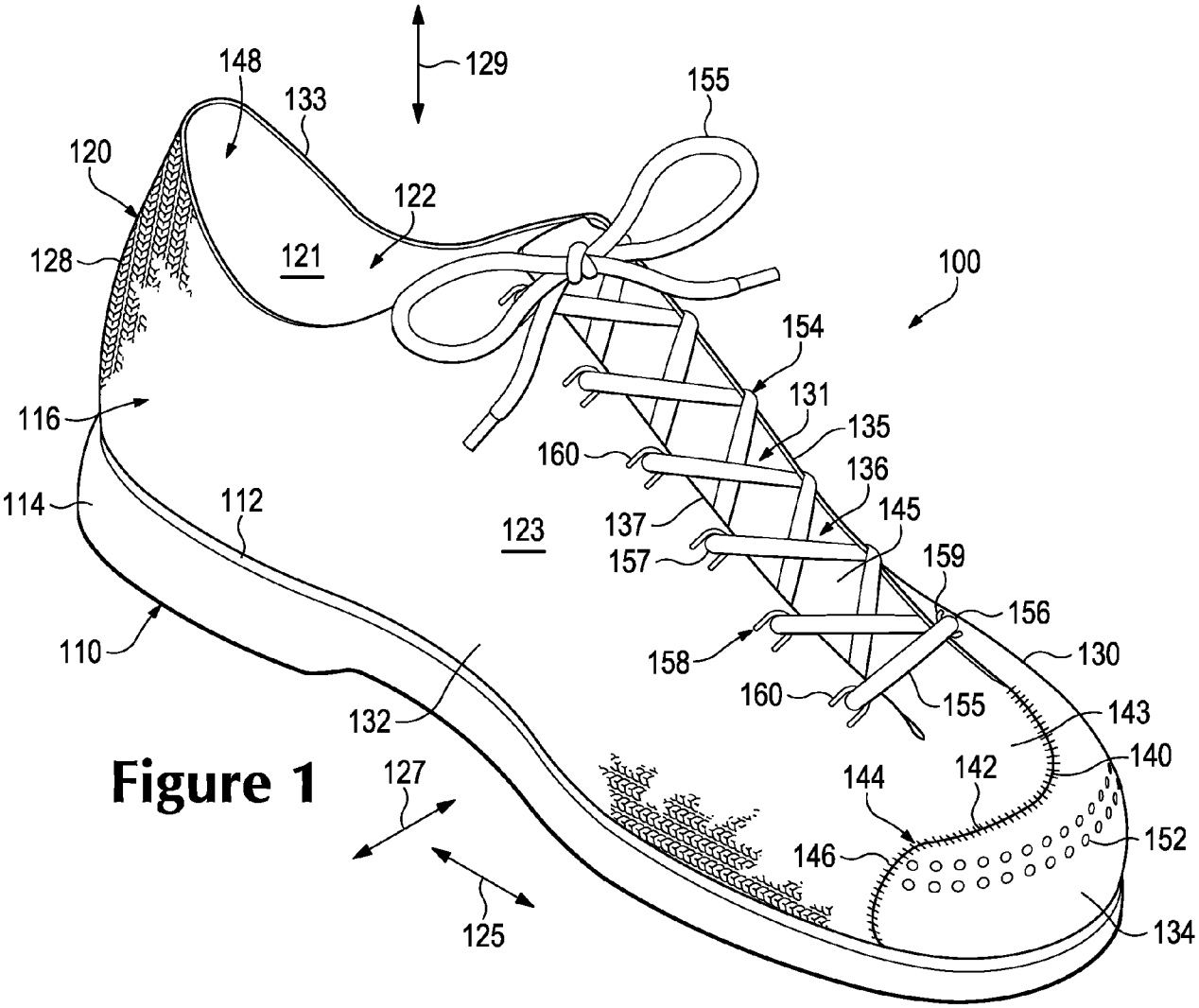
FIG. 1 is a perspective view of an article of footwear according to exemplary embodiments of the present disclosure.
Figure 2:
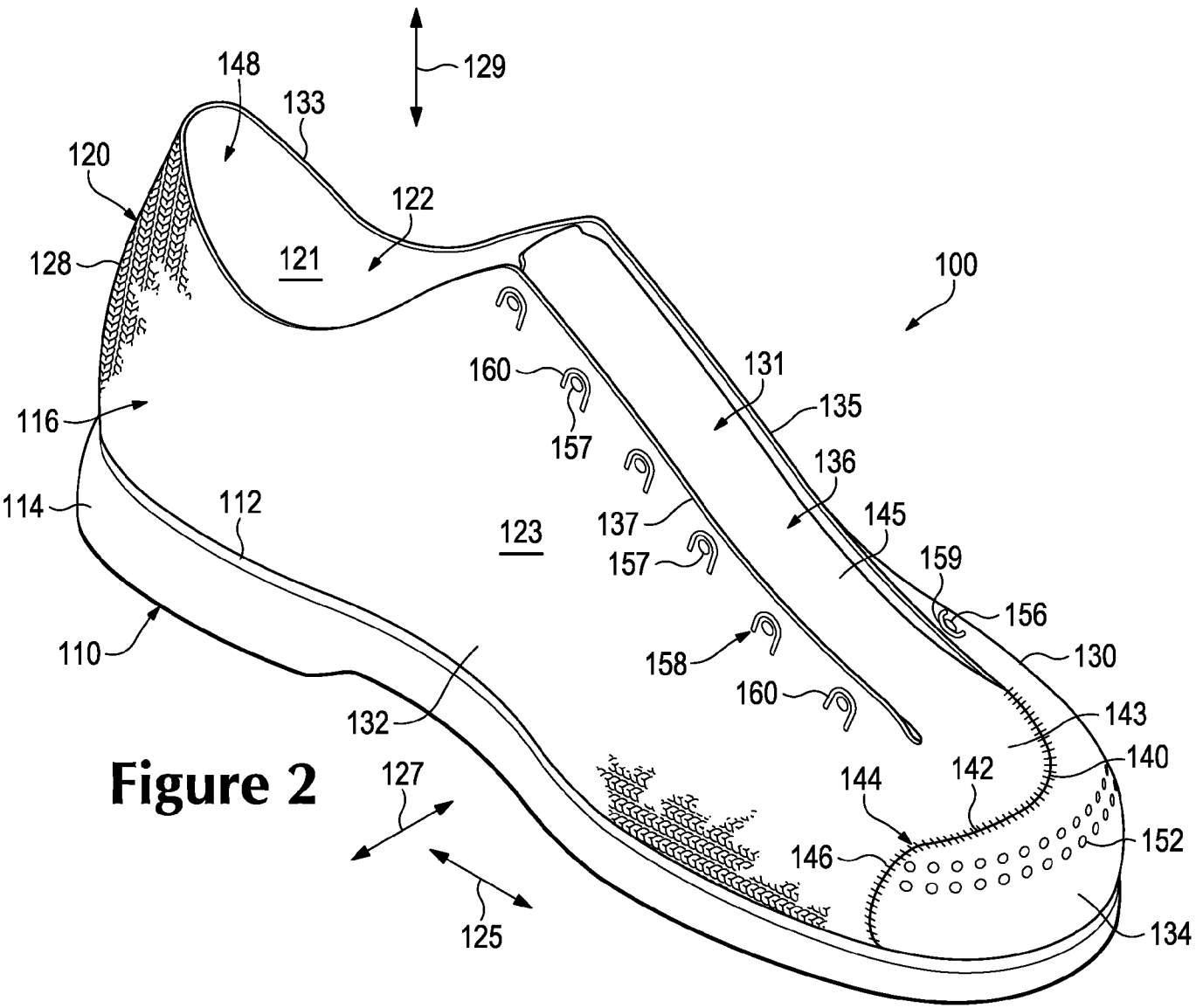
FIG. 2 is a perspective view of the article of footwear of FIG. 1 with a closure member removed.
Figure 3:
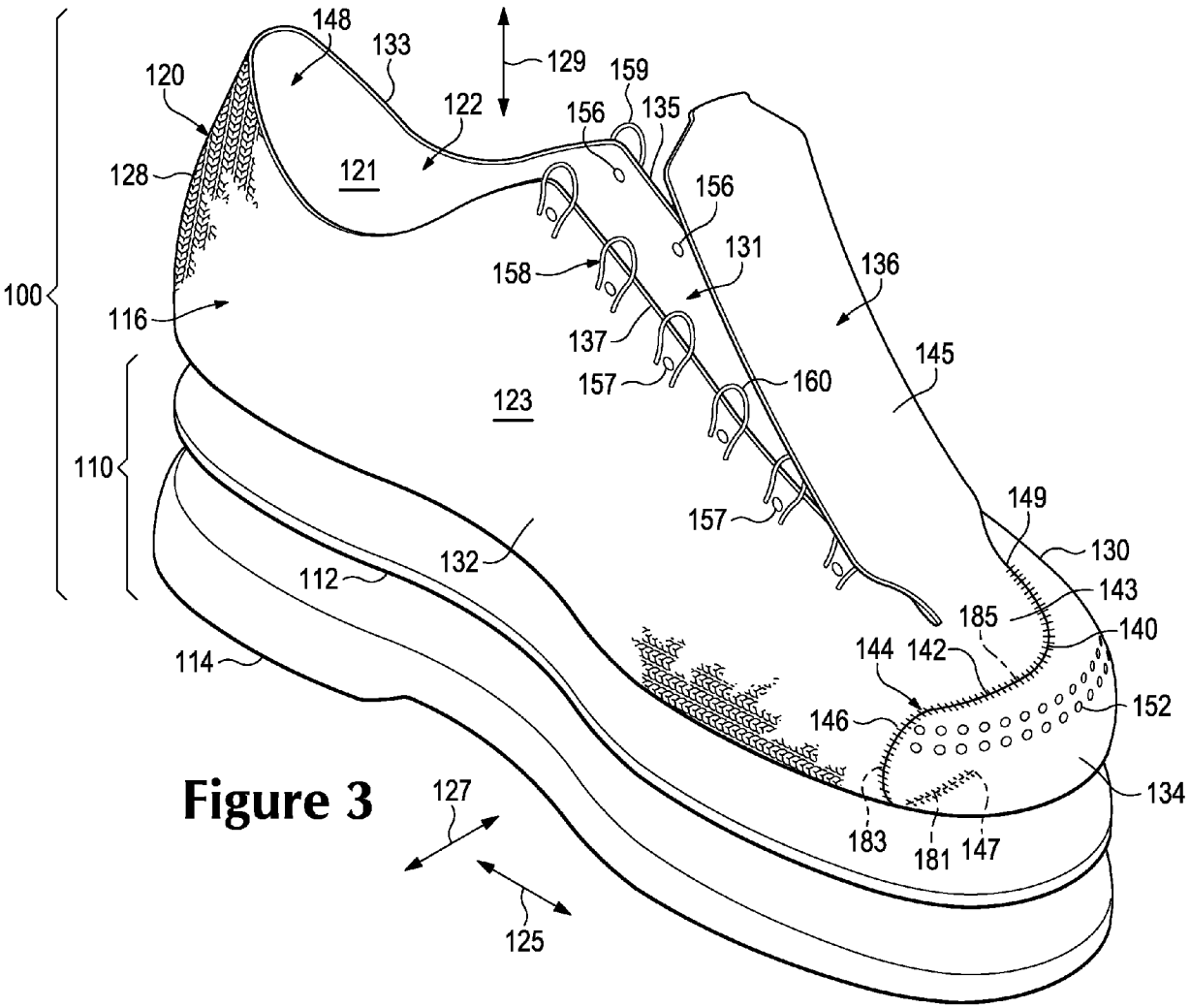
FIG. 3 is an exploded perspective view of the article of footwear of FIG. 2.

Referring initially to FIGS. 1-3, an article of footwear 100 is illustrated according to exemplary embodiments. The footwear 100 can generally include a sole structure 110 and an upper 120.

Sole structure 110 is secured to upper 120 and extends between the foot and the ground when footwear 100 is worn. The sole structure 110 can include a midsole 112 and an outsole 114 that are layered on each other. The midsole 112 can include a resiliently compressible material, fluid-filled bladders, and the like. As such, the midsole 112 can cushion the wearer's foot and attenuate impact and other forces when running, jumping, and the like. The outsole 114 can be secured to the midsole 112 and can include a wear resistant material, such as rubber and the like. The outsole 114 can also include tread and other traction-enhancing features.

Moreover, the upper 120 can define a void 122 that receives a foot of the wearer. Stated differently, the upper 120 can define an interior surface 121 that defines the void 122, and the upper 120 can define an exterior surface 123 that faces in a direction opposite the interior surface 121. When the wearer's foot is received within the void 122, the upper 120 can at least partially enclose and encapsulate the wearer's foot.

Figure 6:
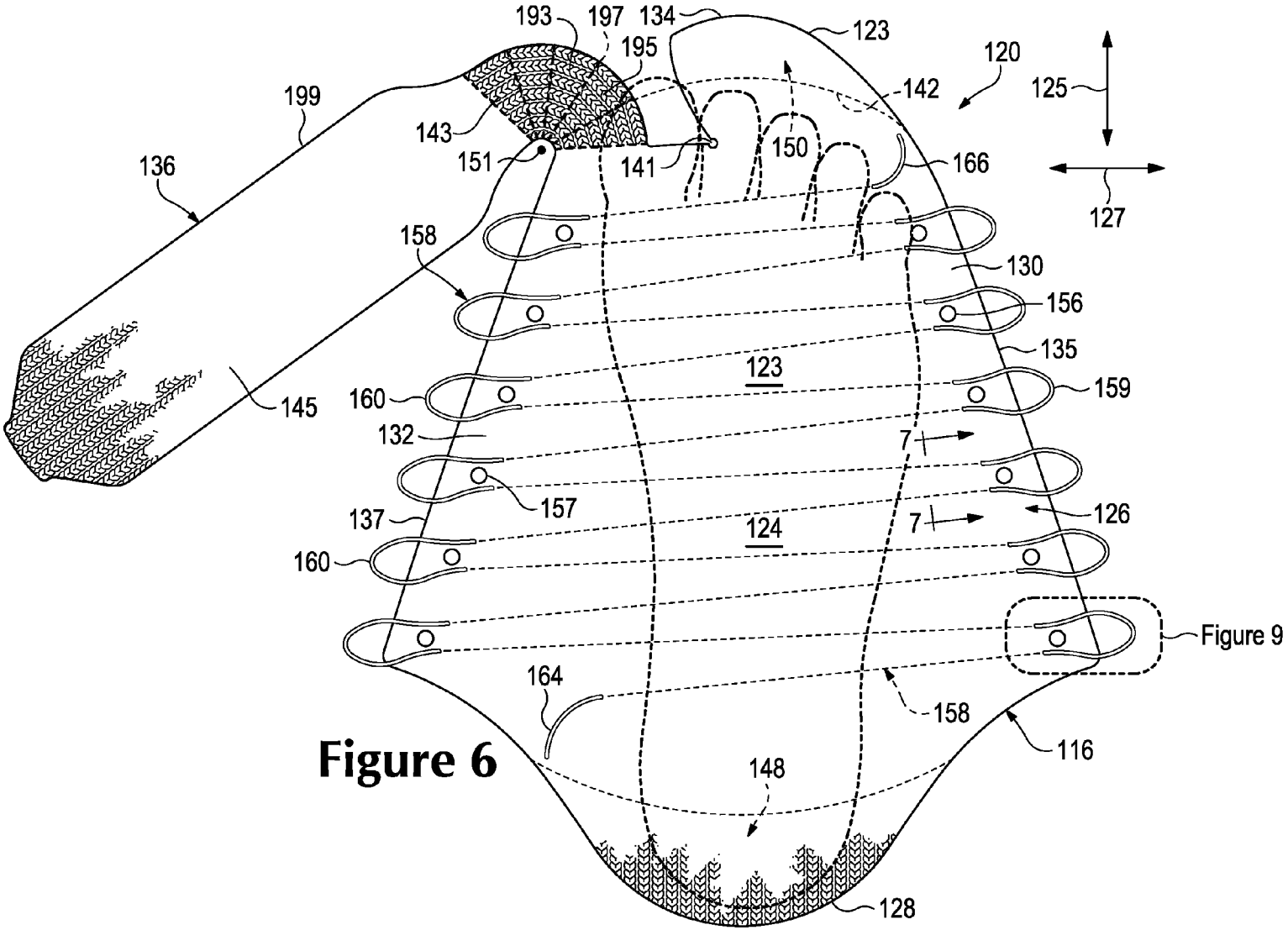
FIG. 6 is a bottom plan view of the knitted component of FIG. 4 with a footprint shown in phantom.

Many conventional footwear uppers are formed from multiple material elements (e.g., textiles, polymer foam, polymer sheets, leather, synthetic leather) that are joined through stitching or bonding, for example. In contrast, at least a portion of upper 120 is formed from a knitted component 116 having a unitary knit construction. The outer boundaries of the knitted component 116 can be defined by a peripheral edge 199, which is shown in FIGS. 5 and 6. As will be discussed, knitted component 116 can define at least a portion of the void within upper 120. Also, the knitted component 116 can define at least a portion of the exterior surface 123 and/or the interior surface 121 of the upper 120.

In some embodiments, the knitted component 116 can define a majority of the upper 120. Decreasing the number of material elements used in forming the upper 120 may decrease waste, while also increasing the manufacturing efficiency and recyclability of the upper 120. As discussed in greater detail below, the knitted component 116 of the upper 120 of the present disclosure can decrease waste and increase manufacturing efficiency and recyclability. Additionally, the knitted component 116 of the upper 120 can incorporate smaller numbers of seams or other discontinuities, thereby enhancing the overall comfort of footwear 100.

The knitted component 116 may also have common properties when formed from the same strand, yarn (or type of yarn) or with similar knit structures. For example, using the same strand in various portions of the knitted component 116 can impart similar durability, strength, stretch, wear-resistance, biodegradability, thermal, and hydrophobic properties. In addition to physical properties, using the same strand in multiple portions of the knitted component 116 can impart common aesthetic or tactile properties, such as color, sheen, and texture. Using the same knit structures across different portions of the knitted component 116 may also impart common physical properties and aesthetic properties.

Knitted Component Configurations

Figure 4:
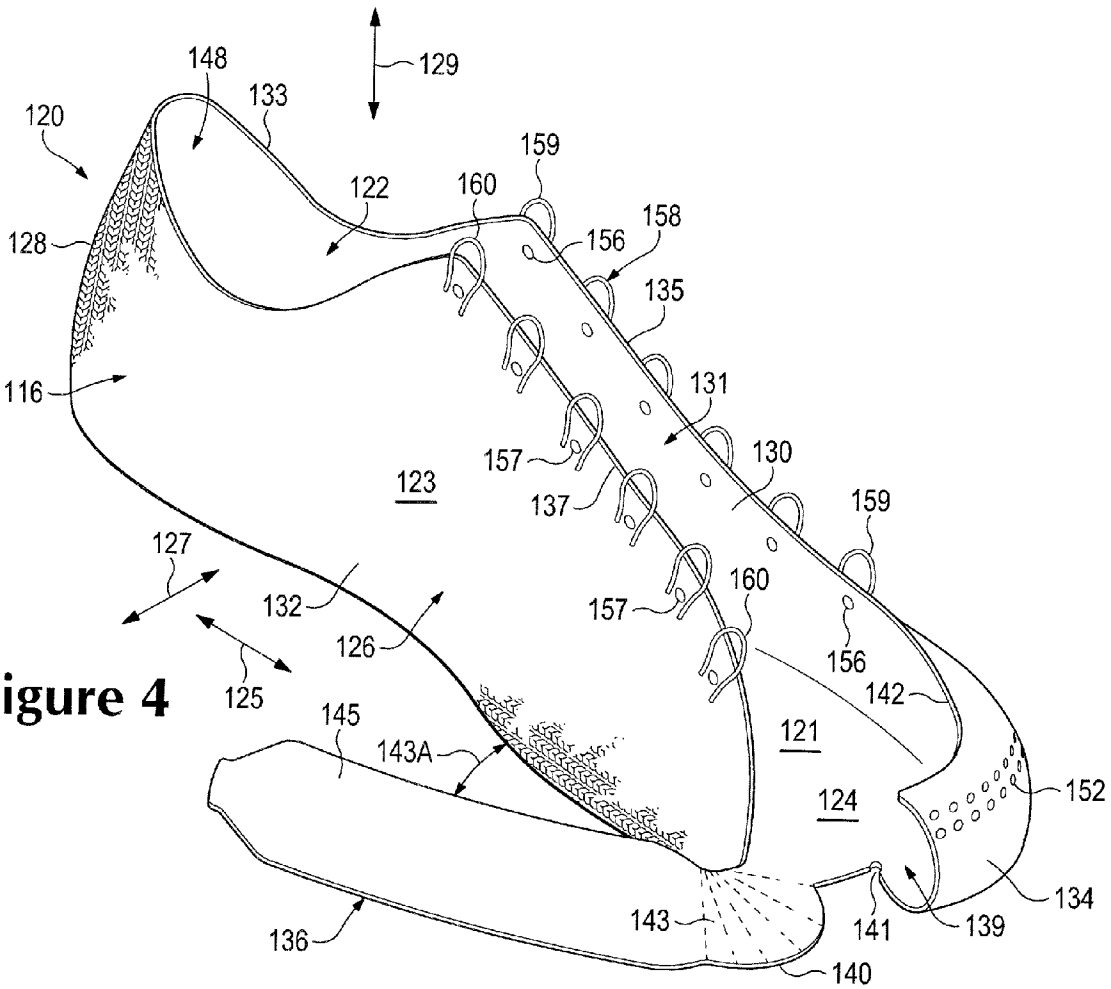
FIG. 4 is a perspective view of a knitted component with inlaid strands of the article of footwear of FIG. 1.

FIGS. 4-6 illustrate various embodiments of knitted components 116 that may be incorporated into articles of footwear in a similar manner as the exemplary embodiment of FIGS. 1 through 3. The knitted component 116 illustrated in FIGS. 4-6 are depicted separate from a remainder of footwear 100. However, it should be understood that each of the embodiments of knitted component 116 described herein may be combined with the elements of footwear 100, described above, to form an article of footwear 100 incorporating the knitted component 116.

The knitted component 116 can be of "unitary knit construction." As defined herein and as used in the claims, the term "unitary knit construction" means that the knitted component 116 is formed as a one-piece element through a knitting process. That is, the knitting process substantially forms the various features and structures of knitted component 116 without the need for significant additional manufacturing steps or processes. A unitary knit construction may be used to form a knitted component having structures or elements that include one or more courses of yarn or other knit material that are joined such that the structures or elements include at least one course in common (i.e., sharing a common strand or common yarn) and/or include courses that are substantially continuous between each portion of the knitted component 116. With this arrangement, a one-piece element of unitary knit construction is provided.

Although portions of knitted component 116 may be joined to each other following the knitting process, knitted component 116 remains formed of unitary knit construction because it is formed as a one-piece knit element. Moreover, knitted component 116 remains formed of unitary knit construction when other elements (e.g., an inlaid strand, a closure element, logos, trademarks, placards with care instructions and material information, and other structural elements) are added following the knitting process.

FIGS. 4-6 illustrate exemplary embodiments of the knitted component 116 as defining a majority of the upper 120 of the article of footwear 100. As shown, the knitted component 116 of the upper 120 can include a base portion 124 or strobel portion or underfoot portion. Also, the knitted component 116 can include one or more side portions 126. The base portion 124 can be configured to be disposed adjacent the sole structure 110. For instance, the base portion 124 can attach directly or indirectly to the sole structure 110 such that the base portion 124 lies over the sole structure 110. In additional embodiments, one or more parts of the base portion 124 (e.g., a periphery of the base portion 124) can attach to the sole structure 110 while other parts remain detached or decoupled. Also, the base portion 124 can be configured to extend underneath the wearer's foot. The side portion(s) 126 can extend from the base portion 124 and can be configured to at least partially cover over the wearer's foot. Also, the base portion 124 and side portion(s) 126 can cooperate to define a void 122 that receives the wearer's foot. Again, the base portion 124 and the side portion(s) 126 can be formed of a unitary knit construction as discussed above.

As shown in the illustrated embodiments, the side portions 126 of the knitted component 116 can include a heel portion 128, a lateral portion 130, a medial portion 132, a forefoot portion 134, and a tongue portion 136, each of which are formed of the same unitary knit construction as the base portion 124. Thus, the knitted component 116 can fit and conform closely to the wearer's foot. Also, because of this construction, the knitted component 116 can be formed relatively quickly to increase manufacturing efficiency.

Also, as shown in FIG. 6 and as will be discussed in detail, the knitted component 116 can include one or more tensile strands 158 that are incorporated with the unitary knit construction of the knitted component 116. For instance, the strands 158 can be inlaid within the courses and/or wales of the knitted component 116 as will be discussed. Also, the strands 158 can be attached to the interior and/or exterior surface of the knitted component 116.

The strand(s) 158 can be disposed in the upper to extend across the sides and/or under the wearer's foot. Also, the strand(s) 158 can be operably coupled to a closure member 154, such as a shoelace 155. Thus, tensioning the shoelace 155 can, in turn, tension the strand(s) 158. As a result, the strand(s) 158 can provide support to the wearer's foot for increased comfort and better fit.

The illustrated embodiments of the upper 120 and the footwear 100 is configured to be worn on a left foot of the wearer. However, it will be appreciated that the footwear 100 can be configured to be worn on the right foot and can include similar features as the illustrated embodiments.

The footwear 100 can also be configured as a running shoe. However, the footwear 100 may also be applied to a variety of other athletic footwear types, including baseball shoes, basketball shoes, cycling shoes, football shoes, tennis shoes, soccer shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to footwear 100 apply to a wide variety of footwear types.

Exemplary Features of Knitted Component

In exemplary embodiments schematically illustrated in FIG. 13, the primary element of knitted component 116 may be formed from at least one yarn 1138 or other strand that is manipulated (e.g., with a knitting machine) to form a plurality of intermeshed loops that define a variety of courses and wales. Although yarn 1138 forms each of the courses and wales in this configuration, additional yarns may form one or more of the courses and/or wales.

The properties that a particular type of yarn will impart to an area of a knitted component partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability.

Additional examples of a suitable configuration for a portion of knitted component 116 is depicted in FIG. 14. In this configuration, knitted component 116 includes yarn 1138 and another yarn 1139 (i.e., plural strands). Yarns 1138 and 1139 are plated and cooperatively form a plurality of intermeshed loops defining multiple horizontal courses and vertical wales. That is, yarns 1138 and 1139 run parallel to each other. An advantage of this configuration is that the properties of each of yarns 1138 and 1139 may be present in this area of knitted component 1130. For example, yarns 1138 and 1139 may have different colors, with the color of yarn 1138 being primarily present on a face of the various stitches in knit element 1131 and the color of yarn 1139 being primarily present on a reverse of the various stitches in knit element 1131. As another example, yarn 1139 may be formed from a yarn that is softer and more comfortable against the foot than yarn 1138, with yarn 1138 being primarily present on first surface 1136 and yarn 1139 being primarily present on second surface 1137.

Moreover, as shown in FIGS. 13 and 14, a strand 1132 can be incorporated in the unitary knit construction of the knitted component 116. The strand 1132 can be a tensile strand element that provides support to the knitted component 116. Stated differently, tension within the strand 1132 can allow the knitted component 116 to resist deformation, stretching, or otherwise provide support for the wearer's foot during running, jumping, or other movements of the wearer's foot. Also, it will be appreciated that the strand 158 of FIG. 6 (mentioned above and described in detail below) can be incorporated in the knitted component 116 similar to the strand 1132 of FIGS. 13 and 14.

As will be discussed, the strand 1132 can be incorporated or inlaid into the unitary knit construction of the knitted component 116 such that the strand 1132 can be incorporated during the knitting processes on the knitting machine. For instance, the strand 1132 can be inlaid within the unitary knit construction such that the strand 1132 extends along one of the courses as shown in FIGS. 13 and 14 and/or the wales of the knitted component 116. As shown in FIGS. 13 and 14, the strand 1132 and can alternate between being located (a) behind loops formed from yarn 1138 and (b) in front of loops formed from yarn 1138. In effect, inlaid strand 1132 weaves through the unitary knit construction of knit element 1131.

The knitted component may also include one or more strands or yarns that are formed from at least one of a thermoset polymer material and natural fibers (e.g., cotton, wool, silk). Other yarns or strands may be formed from a thermoplastic polymer material. In general, a thermoplastic polymer material melts when heated and returns to a solid state when cooled. More particularly, the thermoplastic polymer material transitions from a solid state to a softened or liquid state when subjected to sufficient heat, and then the thermoplastic polymer material transitions from the softened or liquid state to the solid state when sufficiently cooled. As such, thermoplastic polymer materials are often used to join two objects or elements together. In this case, yarn may be utilized to join (a) one portion of yarn to another portion of yarn, (b) yarn and inlaid strand to each other, or (c) another element (e.g., logos, trademarks, and placards with care instructions and material information) to knitted component, for example. As such, yarn may be considered a fusible yarn given that it may be used to fuse or otherwise join portions of knitted component to each other. Moreover, yarn may be considered a non-fusible yarn given that it is not formed from materials that are generally capable of fusing or otherwise joining portions of knitted component to each other. That is, yarn may be a non-fusible yarn, whereas other yarn(s) may be a fusible yarn. In some configurations of knitted component, yarn (i.e., the non-fusible yarn) may be substantially formed from a thermoset polyester material and yarn (i.e., the fusible yarn) may be at least partially formed from a thermoplastic polyester material.

The use of plated yarns may impart advantages to knitted component. When yarn is heated and fused to yarn and inlaid strand, this process may have the effect of stiffening or rigidifying the structure of knitted component. Moreover, joining (a) one portion of yarn to another portion of yarn or (b) yarn and inlaid strand to each other has the effect of securing or locking the relative positions of yarn and inlaid strand, thereby imparting stretch-resistance and stiffness. That is, portions of yarn may not slide relative to each other when fused with yarn, thereby preventing warping or permanent stretching of knit element due to relative movement of the knit structure. Another benefit relates to limiting unraveling if a portion of knitted component becomes damaged or one of yarns is severed. Accordingly, areas of knitted component may benefit from the use of both fusible and non-fusible yarns within knit element.

Additionally, it will be appreciated that the knitted component can have varying zones that collectively form the unitary knit construction. For instance, the knitted component can include a combination at least two of the following: a flat knit zone, a tubular knit zone, a 1×1 mesh knit zone, a 2×2 mesh knit zone, a 3×2 mesh knit zone, a 1×1 mock mesh knit zone, a 2×2 mock mesh knit zone, a 2×2 hybrid knit zone, a full gauge knit zone, a ½ gauge knit zones, and the like. Accordingly, the knitted component 116 and upper 120 can be constructed according to the teachings of U.S. Patent Publication No. 2012/0233882, which published on Sep. 20, 2012, and which is hereby incorporated by reference in its entirety.

Embodiments of Upper and Knitted Component

Various embodiments of the upper 120 and knitted component 116 will now be discussed in greater detail. As shown, the upper 120 can define a longitudinal direction 125, a transverse direction 127, and a vertical direction 129, which will be used for referencing different features of the upper 120 in the below discussion.

As mentioned above, the knitted component 116 of the upper 120 can include a base portion 124, which is configured to be disposed underneath the wearer's foot. An outline of the wearer's foot is shown in FIG. 6, such that the base portion 124 is at least generally defined relative to the wearer's foot. Thus, the base portion 124 can extend continuously underneath one or more portions of the heel, the sole, the toes, the arch, and/or other inferior surfaces of the wearer's foot. In additional embodiments, the base portion 124 can include openings and so as to extend partially or discontinuously under the wearer's foot The knitted component 116 can also include various side portions 126 that extend peripherally from the base portion 124. The side portions 126 can be configured to cover over and lie against at least a portion of the wearer's foot. In the embodiments illustrated, the side portions 126 of the knitted component 116 can substantially encompass the base portion 124. Also, it will be appreciated that the base portion 124 and the side portions 126 can collectively define the interior surface 121 of the knitted component 116 as well as the exterior surface 123 of the knitted component 116.

For instance, the side portions 126 can include a heel portion 128, which is disposed on one end of the base portion 124. The heel portion 128 can also extend upwards from the base portion 124 in the vertical direction 129 as shown in FIG. 4. The heel portion 128 can be configured to cover over a heel and/or an ankle area of the wearer's foot.

The side portions 126 of the knitted component 116 can also include a lateral portion 130, which is disposed forward relative to the heel portion 128, and which can extend upwards from a lateral side of the base portion 124 as shown in FIG. 4. The lateral portion 130 can be configured to cover over and lie against a lateral area of the wearer's foot.

Furthermore, the side portions 126 of the knitted component 116 can include a medial portion 132, which is disposed on an opposite side of the base portion 124 relative to the lateral portion 130 and forward of the heel portion 128. The medial portion 132 can further extend upwards in the vertical direction 129 from the base portion 124 as shown in FIG. 4. The medial portion 132 can be disposed on an opposite side of the base portion 124 in the transverse direction 127. The medial portion 132 can be configured to cover over and lie against a medial area or instep of the wearer's foot.

The heel portion 128, lateral portion 130, and medial portion 132 can collectively define a horseshoe-shaped collar 133 of the upper 120. The collar 133 can provide access into and out of the void 122 of the upper 120. Moreover, a lateral edge 135 of the lateral portion 130 and a medial edge 137 of the medial portion 132 can collectively define a throat 131 of the upper 120. The throat 131 can extend substantially parallel to the longitudinal direction 125, or the throat 131 can be disposed at an angle relative to the longitudinal direction 125. Also, although the throat 131 is substantially centered over the base portion 124 in the embodiments of FIG. 4, the throat 131 can be disposed to one side relative to the base portion 124 in the transverse direction 127. As will be discussed, the width of the throat 131 can be selectively varied by the closure member 154 so as to move the lateral and medial edges 135, 137 toward and away from each other. As a result, the footwear 100 can be selectively tightened on the wearer's foot and loosened from the wearer's foot.

Additionally, the side portions 126 of the knitted component 116 can include a forefoot portion 134. The forefoot portion 134 can be disposed on an opposite end of the base portion 124 relative to the heel portion 128 and forward of the lateral and medial portions 130, 132 in the longitudinal direction 125 as shown in FIG. 1. Also, the forefoot portion 134 can be integrally connected to either the lateral portion 130 or the medial portion 132, and the forefoot portion 134 can be spaced from the other. In the embodiments shown, for instance, the forefoot portion 134 is integrally connected to the lateral portion 130 and is spaced from the medial portion 132. Accordingly, when the upper 120 is in a disassembled state as shown in FIG. 4, a gap 139 can be defined between the forefoot portion 134 and the medial portion 132.

Still further, the side portions 126 of the knitted component 116 can include a tongue portion 136. As shown in FIG. 4, the tongue portion 136 can include a curved region 143 and a longitudinal region 145. When the upper 120 is disassembled as shown in FIG. 4, the tongue portion 136 can extend generally forward from the base portion 124, and the curved region 143 can be disposed within the gap 139 between the medial and forefoot portions. The curved region 143 can also curve such that the longitudinal region 145 extends generally rearwardly and at an angle 143 relative to the medial portion 132 as shown in FIG. 4. The curvature of the curved region 143 can be achieved by having knit courses that substantially radiate from a common area 151 as shown in FIG. 5. The common area 151 can be an imaginary point that is spaced from the periphery of the curved region 143, between the tongue portion 136 and the medial portion 132 as shown, or the common area 151 can be disposed elsewhere. Also, when the upper 120 is assembled, the curved region 143 can wrap upwards to at least partially fill the gap 139, and the longitudinal region 145 of the tongue portion 136 can be disposed within the throat 131 of the upper to cover over the wearer's foot between the lateral portion 130 and the medial portion 132. Moreover, when the upper 120 is assembled, the longitudinal region 145 of the tongue portion 136 can be detached and decoupled from the lateral and/or medial portions 130, 132 as shown in FIG. 3.

As shown in FIGS. 4, 5, and 6, the base portion 124 and the heel portion 128 can define a heel cavity 148 that is configured to receive a heel of the wearer's foot (see FIG. 6). The heel cavity 148 can have interior and/or exterior surfaces with three dimensional curvature. Also, the heel cavity 148 can have a convex outer surface. Thus, as the heel portion 128 extends in the vertical direction 129 from the base portion 124, the heel portion 128 can curve forward slightly in the longitudinal direction 125. Also, as the heel portion 128 extends in the transverse direction 127, both sides of the heel portion 128 can curve forward in the longitudinal direction 125 to join to the lateral and medial portions 130, 132. Accordingly, the heel cavity 148 can conform and approximately correspond to the shape of the wearer's heel and ankle.

Furthermore, as shown in FIGS. 4, 5, and 6, the base portion 124 and the forefoot portion 134 can define a forefoot cavity 150 that is configured to receive the toes and other forefoot regions of the wearer's foot (see FIG. 6). The forefoot cavity 150 can have interior and/or exterior surfaces with three dimensional curvature. Also, the forefoot cavity 150 can have a convex outer surface. Thus, as the forefoot portion 134 extends in the vertical direction 129 from the base portion 124, the forefoot portion 134 can curve rearwardly in the longitudinal direction 125. Also, as the forefoot portion 134 extends in the transverse direction 127, the forefoot portion 134 can curve rearwardly in the longitudinal direction 125 to join to the lateral portion 130.

The three dimensional curvature of the heel cavity 148 and/or the forefoot cavity 150 can be formed due to the unitary knit construction of the knitted component 116. For instance, as shown in FIG. 8, the heel portion 128 can include at least two tapered areas 170, 171. The tapered areas 170, 171 can have boundaries 173 that taper generally in the transverse direction 127 as indicated by broken lines. The tapered areas 170, 171 each have a plurality of courses, or row of stitches; however, the successive courses can have different lengths to thereby provide the tapered shape of the boundaries 173. Thus, the tapered areas 170, 171 can have an eye shape, a double pointed oval shape, a biconvex shape, or a crescent shape.

Also, the boundary 173 of the tapered area 170 is joined to the boundary 173 of the tapered area 171 in the unitary knit construction to provide the knitted component 116 with three dimensional curvature. This can produce a visually evident distortion along the joined boundaries 173. The distortion can be a so-called fully fashioned mark extending along the joined boundaries 173 in the knitted component 116.

In the embodiments of FIG. 8, there are a plurality of tapered areas that are joined along respective boundaries such that the tapered areas extend from the collar 133 to the base portion 124 and a majority of the heel portion 128 includes these tapered areas. Accordingly, a majority of the heel portion 128 can have three-dimensional curvature. However, it will be appreciated that knitted component 116 can include any number of tapered areas 170, 171 on any portion of the knitted component 116 to provide three dimensional curvature to the knitted component 116. Also, the tapered areas 170, 171 can be oriented in any suitable direction on the knitted component 116. For instance, the forefoot portion 134 can similarly include tapered areas; however, such tapered areas can taper in the vertical direction 129 in exemplary embodiments.

The curved region 143 of the tongue portion 136 can also include a plurality of tapered areas that provide the curved region 143 with curvature. For instance, the curved region 143 can include tapered areas 193, 195 that are integrally knit together and joined along boundaries 197. This can produce a visually evident distortion along the joined boundaries 197. The distortion can be a so-called fully fashioned mark extending along the joined boundaries 197 in the knitted component 116. Additionally, as mentioned above, the courses within the curved region 143 can radiate from common area 151 to provide two-dimensional curvature.

Also, in some embodiments, the forefoot portion 134 can include a plurality of openings 152 that are arranged to assist with increasing curvature of the forefoot portion 134. In the embodiments illustrated, the plurality of openings 152 can include one or more rows of through-holes. Because the openings 152 reduce the amount of knitted material at those areas of the forefoot portion 134, the forefoot portion 134 can readily curve rearward toward the heel portion 128.

The knitted component 116 can additionally include at least two edge portions 140, 142 that are configured to be joined together when assembling the upper 120. It will be appreciated that the first edge portion 140 can be a first longitudinal section of larger peripheral edge 199 of the knitted component 116 shown in FIGS. 5 and 6. It will also be appreciated that the second edge portion 142 can be a second longitudinal section of the peripheral edge 199. The edge portions 140, 142 can be defined in any suitable location long the peripheral edge 199 and/or anywhere on the knitted component 116. As shown in FIGS. 5 and 6, the first edge portion 140 can extend along the curved region 143 of the tongue portion 136 and can also extend partially through the base portion 124 in the transverse direction 127, adjacent the forefoot portion 134. The second edge portion 142 can curve along the forefoot portion 134, generally in the transverse direction 127 and can extend downward in the vertical direction 129 along the forefoot portion 134 so as to partially define the gap 139. The first edge 140 and the second edge 142 can also meet at a notch 141 defined within the base portion 124 as shown in FIG. 4.

As mentioned above, the footwear 100 can further include a closure member 154, which is illustrated in FIG. 1. The closure member 154 can selectively secure the upper 120 to the wearer's foot and selectively release the upper 120 from the wearer's foot.

As shown in FIG. 1, the closure member 154 can be a shoelace 155. As such, the lateral portion 130 can include one or more lateral closure openings 156, such as through-holes that are disposed in a row extending along the lateral edge 135. The medial portion 132 can include similar medial closure openings 157 that are disposed in a row extending along the medial edge 137. The openings 156, 157 can receive the shoelace 155 such that the shoelace 155 can criss-cross, zigzag, and alternate between the lateral and medial portions 130, 132.

It will be appreciated that the openings 156, 157 could be configured differently from the through-holes shown in FIG. 1. For instance, the openings 156, 157 could be defined by hoops, grommets, hooks, and other suitable features that are configured to receive a closure member and that are either integrated into the knitted component 116 or are removably attached to the knitted component 116.

Also, it will be appreciated that the closure member 154 could include structure other than the shoelace 155 without departing from the scope of the present disclosure. For instance, the closure member 154 could be a strap, a buckle, pile tape, or other suitable closure member.

Still further, as shown in FIG. 6, the upper 120 can include at least one tensile strand 158 that is coupled to the base portion 124 and/or the side portions 126. The strand 158 can be coupled to any portion of the base portion 124 and/or the side portion 126. Additionally, the strand 158 can be coupled to the base portion 124 and/or the side portion 126 in any suitable fashion. For instance, the strand 158 can be inlaid within courses and/or wales of the unitary knit construction of the base portion 124 and side portions 126 as will be discussed. Thus, the strand 153 can correspond to the strand 1132 described above and shown in FIGS. 13 and 14. The strand 158 can also be adhered, fastened, pierced through, or otherwise coupled to the interior or exterior surfaces 121, 123 of the base portion 124 and/or the side portion 126.

The strand 158, knitted component 116, and upper 120 can incorporate the teachings of one or more of commonly-owned U.S. patent application Ser. No. 12/338,726 to Dua et al., entitled "Article of Footwear Having An Upper Incorporating A Knitted Component", filed on Dec. 18, 2008 and published as U.S. Patent Application Publication Number 2010/0154256 on Jun. 24, 2010, and U.S. patent application Ser. No. 13/048,514 to Huffa et al., entitled "Article Of Footwear Incorporating A Knitted Component", filed on Mar. 15, 2011 and published as U.S. Patent Application Publication Number 2012/0233882 on Sep. 20, 2012, both of which applications are hereby incorporated by reference in their entirety (collectively referred to herein as the "Inlaid Strand cases").

The strand 158 can be an elongate and flexible. Also, the strand 158 can include at least one yarn, cable, wire, string, cord, filament, fiber, thread, rope, and the like. Also, the strand 158 can be formed from rayon, nylon, polyester, polyacrylic, silk, cotton, carbon, glass, aramids (e.g., para-aramid fibers and meta-aramid fibers), ultra high molecular weight polyethylene, liquid crystal polymer, copper, aluminum, steel, or other suitable material. An individual filament utilized in the strand 158 may be formed form a single material (i.e., a monocomponent filament) or from multiple materials (i.e., a bicomponent filament). Similarly, different filaments may be formed from different materials. As an example, yarns utilized as strand 158 may include filaments that are each formed from a common material, may include filaments that are each formed from two or more different materials, or may include filaments that are each formed from two or more different materials. Similar concepts also apply to threads, cables, ropes, etc. The thickness (diameter) of strand 158 can be within a range from approximately 0.03 millimeters to 5 millimeters, for example. Also, the strand 158 can have a substantially circular cross section, an ovate cross section, or a cross section of any other suitable shape.

As an example, the strand 158 may be formed from a bonded nylon 6.6 with a breaking or tensile strength of 3.1 kilograms and a weight of 45 tex. The strand 158 can also be formed from a bonded nylon 6.6 with a breaking or tensile strength of 6.2 kilograms and a tex of 45. As a further example, the strand 158 may have an outer sheath that sheathes and protects an inner core.

In some embodiments, the strand 158 can have a fixed length (e.g., can be nonextendible). Also in some embodiments, the strand 158 can be resiliently extendible.

Additionally, in some embodiments, the strand 158 can include a thermoplastic material that is configured to adhere, bond, or fuse to the base portion 124 and/or the side portions 126 of the upper 120. For instance, selective application of heat can cause materials in the strand 158 to fuse to the materials of the base portion 124 and/or the side portions 126. The strand 158 can, thus, be included according to the teachings of U.S. Patent Publication No. 2012/0233882, which published on Sep. 20, 2012, and which is incorporated herein by reference in its entirety.

As shown in the embodiments of FIG. 6, the upper 120 can include a single strand 158 that extends continuously between the medial portion 132, the base portion 124, and the lateral portion 130. Also, the strand 158 can include one or more turns 159, 160. The turns 159, 160 can be one hundred eighty degree turns or greater. Specifically, the strand 158 can include a plurality of lateral turns 159 that are arranged in a row along the lateral edge 135, and the strand 158 can include a plurality of medial turns that are arranged in a row along the medial edge 137. The strand 158 can also extend linearly between pairs of the turns 159, 160. Additionally, the strand 158 can include a first terminal end 164 that is disposed adjacent the heel portion 128, and the strand 158 can include a second terminal end 166 that is disposed adjacent the forefoot portion 134. The strand 158 can also alternatingly extend and zigzag between the lateral and medial portions 130, 132.

Figure 7:
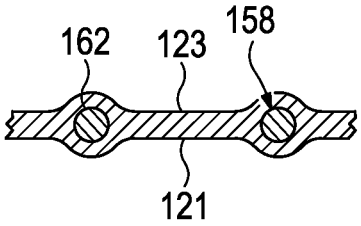
FIG. 7 is a section view of the knitted component taken along the line 7-7 of FIG. 6.

Furthermore, as shown in FIGS. 6 and 7, the knitted component 116 can define a passage 162 between the interior surface 121 and the exterior surface 123. The passage 162 can be defined in any suitable fashion. For instance, in embodiments in which the strand 158 is inlaid within the knitted component 116, the passage 162 can be defined through one or more courses or wales of the knitted component 116. Also, in some embodiments, the interior surface 121 can be defined by a layer of knitted material and the exterior surface 123 can be defined by a separate layer of knitted material, and a plurality of strands, filaments, or monofilaments can extend and provide spacing between these layers (e.g., a so-called "spacer knit material"). In these embodiments, the passage 162 can be defined between the layers of knitted material and among the plurality of spacer strands. In additional embodiments, the interior surface 121 and the exterior surface 123 can be interconnected stitched surfaces, and the passage 162 can be defined between these surfaces.

The passage 162 can extend across any portion of the upper 120. For instance, as indicated by broken lines in FIG. 6, the upper 120 can define a plurality of passages 162, and each passage 162 can extend continuously between the lateral portion 130, the base portion 124, and the medial portion 132. In the embodiments shown, each passage 162 extends partially across the lateral portion 130 (lateral passage), partially across the base portion 124 (base portion passage), and partially across the medial portion 132 (medial passage) such that the passage 162 is continuous between the lateral portion 130, the base portion 124, and the medial portion 132. However, it will be appreciated that one or more passage 162 can be localized and isolated on any portion of the upper 120.

As shown in FIG. 7, the strand 158 can be received and can extend longitudinally within one or more of the passages 162 so as to extend between the lateral portion 130, the base portion 124, and the medial portion 132. Also, the turns 159, 160 of the strand 158 can be exposed from the passages 162.

The lateral turns 159 can extend at least partially around respective ones of the lateral closure openings 156, and the medial turns 160 can extend at least partially around respective ones of the medial closure openings 157. Furthermore, as shown in FIG. 1, the shoelace 155 can be received within respective pairs of the lateral closure openings 156 and the lateral turns 159, and the shoelace 155 can also be received within respective pairs of the medial closure openings 157 and the medial turns 160. Stated differently, each pairing of lateral turn 159 and lateral closure opening 156 can cooperatively receive and support the shoelace 155, and each pairing of medial turn 160 and medial closure opening 157 can also receive and support the shoelace 155.

In some embodiments, the strand 158 can be loosely and moveably received within the respective passages 162. For instance, the strand 158 can slide longitudinally through the passages 162. Thus, as shown in FIG. 9, the turns 159, 160 can be pulled closer to the respective closure opening 156, 157. In additional embodiments, the first and/or the second terminal end 164, 166 of the strand 158 can be fixed (e.g., fused) to the base portion 124 while remaining portions of the strand 158 can remain moveable relative to the base, lateral, and medial portions 124, 130, 132. In still additional embodiments, portions of the strand 158 between the terminal ends 164, 166 can be fused or otherwise fixed to the base, lateral, and medial portions 124, 130, 132.

Accordingly, tensioning the shoelace 155 can, in turn, increase tension in the strand 158. For instance, as shown in FIG. 10, when the shoelace 155 is loose and in the unsecured position, tension in the strand 158 can be relatively low, thereby allowing the upper 120 to fit loosely about the wearer's foot. However, when the shoelace 155 is pulled and tensioned as indicated by arrows 174, 175, the shoelace 155 can pull on the turns 159, 160 to increase tension in the strand 158. As a result, the strand 158 can pull and conform the upper 120 closely to the wearer's foot as indicated by arrows 176, 177, 178, 179 in FIG. 11.

It will be appreciated that in the embodiments shown in FIGS. 10 and 11, the strand 158 can provide support for various areas on the bottom of the wearer's foot. For instance, the strand 158 can be disposed on an arch region 164 that is configured to be disposed underneath the arch of the wearer's foot. Thus, the strand 158 within the arch region 164 can support the wearer's arch, especially when the strand 158 is tensioned by the shoelace 155.

It will also be appreciated that, in the embodiments illustrated, the upper 120 can include only one continuous strand 158 for providing such support to the foot. Accordingly, the part count of the upper 120 can be relatively low, and the upper 120 can be constructed in an efficient manner.

Assembly of the Footwear

Assembly of the footwear 100, the knitted component 116 and upper 120 will now be discussed according to exemplary embodiments. For purposes of clarity, it will be assumed that the knitted component 116 and the strand 158 have been formed to the disassembled state shown in FIGS. 5 and 6.

To begin exemplary embodiments of the assembly of the upper 120, the lateral and medial portions 130, 132 can be moved (folded) superiorly to the position shown in FIG. 4. Then, the tongue portion 136 can be wrapped superiorly such that the curved region 143 substantially fills the gap 139 and the longitudinal region 145 substantially fills the throat 131. As such, the first and second edge portions 140, 142 can be disposed directly adjacent each other. Then, the first and second edge portions 140, 142 can be joined at a seam 144.

The first and second edge portions 140, 142 can be joined at the seam 144 in any suitable fashion. For instance, the first and second edge portions 140, 142 can be joined using stitching, adhesives, tape, bonding, welding, fasteners, or other suitable attachment devices.

In some embodiments, the seam 144 can be formed by stitching the edge portions 140, 142 together with stitching 146 as shown in FIGS. 1-3. As mentioned above, the upper 120 can be a knitted element with a plurality of stitches; however, it will be appreciated that the stitching 146 can be independent of the stitches of the knitted component 116. Stated differently, the stitching 146 can be formed using one or more threads, yarns, cables, or other strands that are attached after the knitted component 116 has been knitted. The stitching 146 can also be a zigzag stitch or other suitable stitch. Additionally, the edge portions 140, 142 can abut at the seam 144. For instance, the edge portions 140, 142 can form a butt joint, or the edge portions 140, 142 can be partially overlapped to form the seam 144. Additionally, the edge portions 140, 142 can be slightly spaced apart at the seam 144 with a bead of adhesive or other material between the edge portions 140, 142 at the seam 144.

Moreover, the seam 144 can extend across any suitable portion of the knitted component 116. For instance, in the embodiments of FIG. 3, the seam 144 can include a first terminal end 147 disposed in the base portion 124, adjacent the forefoot portion 134. The seam 144 can also include a second terminal end 149 at the junction of the lateral edge 135, the forefoot portion 134, and the tongue portion 136. Also, the seam 144 can extend continuously between the first and second terminal ends 147, 149 in some embodiments. For instance, the seam 144 can include a first portion 181 that extends across the base portion 124 generally in the transverse direction 127 toward the medial portion 132 from the first terminal end 147. The seam 144 can also include a second portion 183 that extends generally in the vertical direction 129 across the medial portion 132 and adjacent the forefoot portion 134. The seam 144 can further include a third portion 185 that extends generally in the transverse direction toward the lateral side 130 and that curves rearwardly toward the second terminal end 149. Thus, the seam 144 can extend continuously between the ends 147, 149 so as to extend from under the wearer's foot, around a medial area of the wearer's forefoot, to an area above the wearer's forefoot.

Also, there can be any number of seams 144 of the knitted component 116. As shown in the embodiments of FIG. 3, for instance, there can be only one, solitary seam 144 necessary for giving the knitted component 116 of the upper 120 the three dimensional shape shown in FIGS. 1-3. This can facilitate manufacturing and reduce time for assembly of the upper 120.

Also, the seam 144 can be spaced from the heel portion 128 such that the heel portion 128 is seamless. Thus, even if the heel portion 128 shifts on the wearer's heel, the relatively smooth and seamless heel portion 128 is unlikely to rub on the wearer's heel and provide discomfort to the wearer.

Subsequently, the shoelace 155 can be threaded through the lateral and medial openings 156, 157 and the lateral and medial turns 159, 160 as discussed above. Next, the sole structure 110 can be attached to the upper 120. Specifically, the midsole 112 can be attached to the exterior surface 123 of the base portion 124, and the outsole 114 can be attached to the midsole 112. In additional embodiments, an additional sockliner can be inserted over and/or attached to the interior surface 121 of the base portion 124.

Additional Embodiments of Knitted Component and Upper

Additional embodiments of the knitted component 116 of the upper 220 are illustrated in FIG. 12. The knitted component 116 and upper 220 can be substantially similar to the knitted component 116 and upper 120 described above, except as discussed.

The upper 220 can include a strand 258 that alternatingly extends across the medial portion 232, the base portion 224, and the lateral portion 230, similar to the embodiments discussed above. The strand 258 can also extend through one or more passages 262. However, the passages 262 can be defined on the medial portion 132 and the lateral portion 130, and the passages 262 can be spaced away from the base portion 224.

Accordingly, longitudinal portions of the strand 258 extending across the base portion 224 can be exposed from the passages 262. Also, these portions of the strand 258 can be detached and decoupled from the base portion 224. Thus, in some embodiments, these portions of the strand 258 can be free to be attached directly to the sole structure 110.

Furthermore, as shown in FIG. 12, in some embodiments, the passages 262 can be V-shaped such that the turns of the strand 258 are embedded and enclosed within the passages 262 unlike the exposed turns 159, 160 shown above in FIGS. 1-6.

Exemplary Knitting Processes for Forming Knitted Component and Upper

The knitted component 116 can be knitted in any suitable direction. For instance, the knitted component 116 can be formed from the heel portion 128, at the collar 133, and the knitted component 116 can be formed so as to grow generally in the longitudinal direction 125 toward the forefoot portion 134. The forefoot cavity 150 can be formed before the tongue portion 136. Then, the tongue portion 136 can be subsequently formed. It will also be appreciated that the three dimensionally curved cavities and the two dimensionally curved portions of the knitted component 116 (such as the heel cavity 148, the forefoot cavity 150, the curved region 143 and/or other areas) can be formed unitarily during the knitting process. Specifically, the stitches at the boundaries 173, 197 can be held by respective needles as subsequent courses of stitches are added, and the held stitches at the boundaries 173, 197 can be knitted to respective stitches across the boundaries 173, 197. Also, the strand 158 can be inlaid during this knitting process. Also, this process can be completed on any suitable machine, such as a flat knitting machine.

Referring now to FIGS. 15-23, exemplary automated knitting processes for forming the knitted component 116 with the strand 158 will be discussed. For purposes of discussion, flat knitting processes and flat knitting machines will be discussed, however, the knitted component 116 and strand 158 can be otherwise formed without departing from the scope of the present disclosure. Thus, the knitted component 116 and strand 158 can be formed according to the teachings of U.S. Patent Publication No. 2012/0233882, which published Sep. 20, 2012, and which is hereby incorporated by reference in its entirety.

Figure 15:
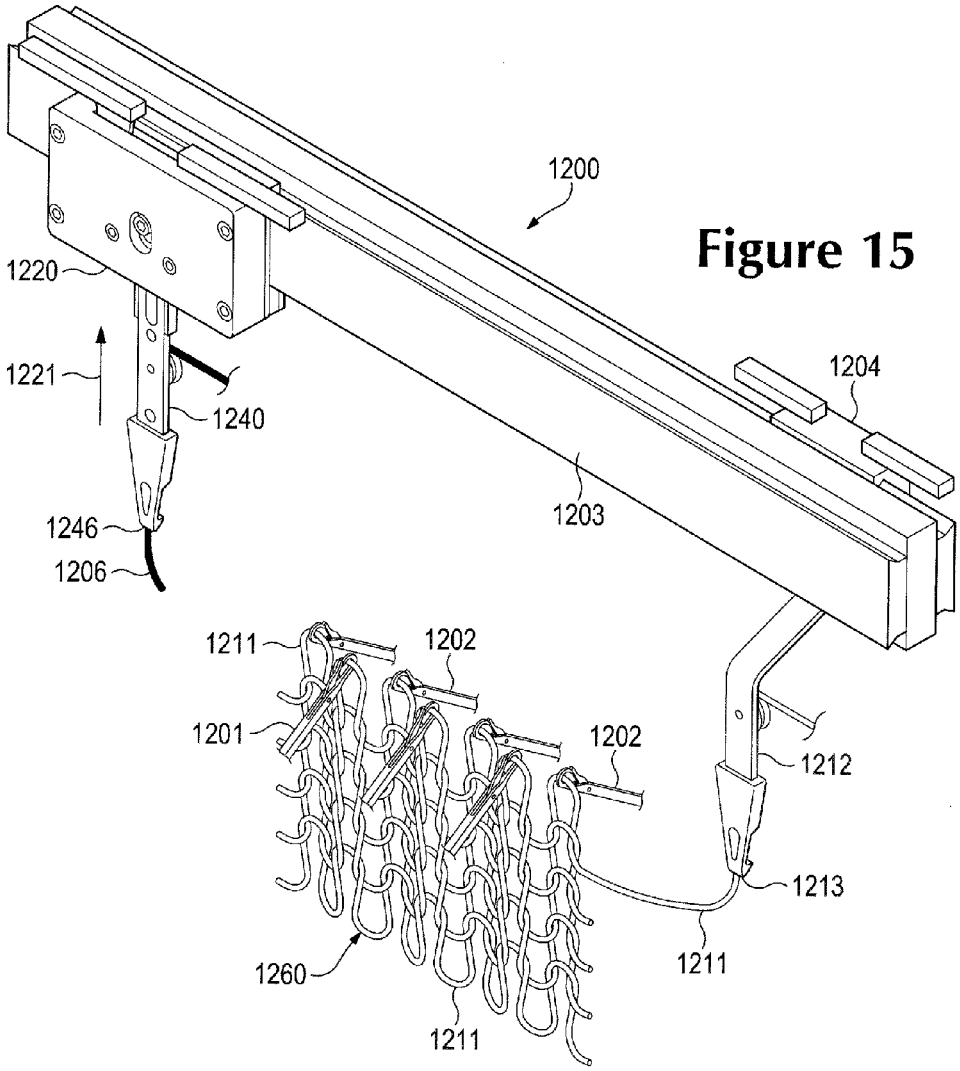

Referring to FIG. 15, a portion of knitting machine 1200 that includes various needles 1202, rail 1203, standard feeder 1204, and combination feeder 1220 is depicted. Whereas combination feeder 1220 is secured to a front side of rail 1203, standard feeder 1204 is secured to a rear side of rail 1203. Yarn 1206 passes through combination feeder 1220, and an end of yarn 1206 extends outward from dispensing tip 1246. Although yarn 1206 is depicted, any other strand (e.g., filament, thread, rope, webbing, cable, chain, or yarn) may pass through combination feeder 1220. Another yarn 1211 passes through standard feeder 1204 and forms a portion of a knitted component 1260, and loops of yarn 1211 forming an uppermost course in knitted component 1260 are held by hooks located on ends of needles 1202.

The knitting process discussed herein relates to the formation of knitted component 1260 or portion of knitted component 1260. Thus, the portion of the knitted component 1260 can correspond to the base portion 124, the heel portion 128, the lateral portion 130, the medial portion 132, the forefoot portion 134, and/or the tongue portion 136 discussed above in relation to FIGS. 1-6. For purposes of the discussion, only a relatively small section of knitted component 1260 is shown in the figures in order to permit the knit structure to be illustrated. Moreover, the scale or proportions of the various elements of knitting machine 1200 and knitted component 1260 may be enhanced to better illustrate the knitting process.

Figure 16:
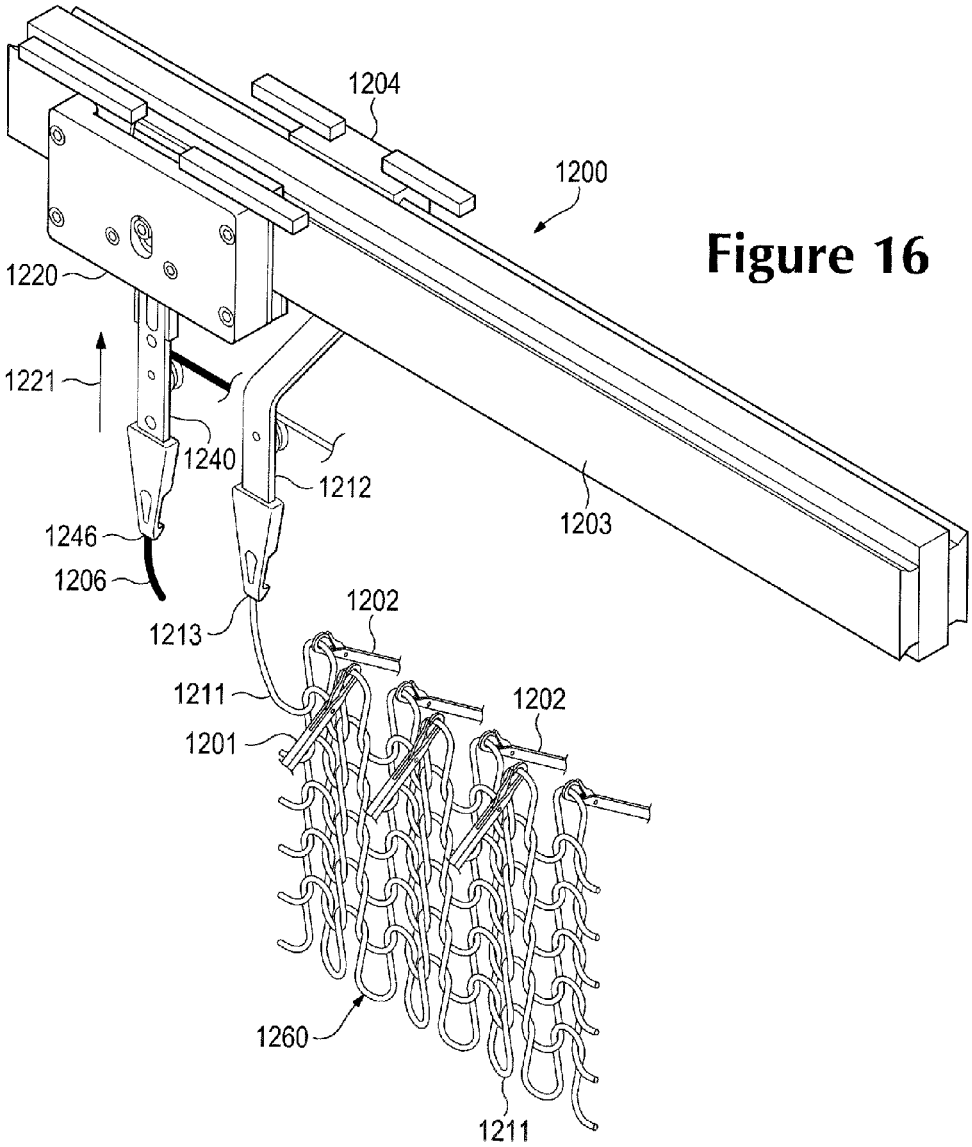

Referring now to FIG. 16, standard feeder 1204 moves along rail 1203 and a new course is formed in knitted component 1260 from yarn 1211. More particularly, needles 1202 pulled sections of yarn 1211 through the loops of the prior course, thereby forming the new course. Accordingly, courses may be added to knitted component 1260 by moving standard feeder 1204 along needles 1202, thereby permitting needles 1202 to manipulate yarn 1211 and form additional loops from yarn 1211.

Figure 17:
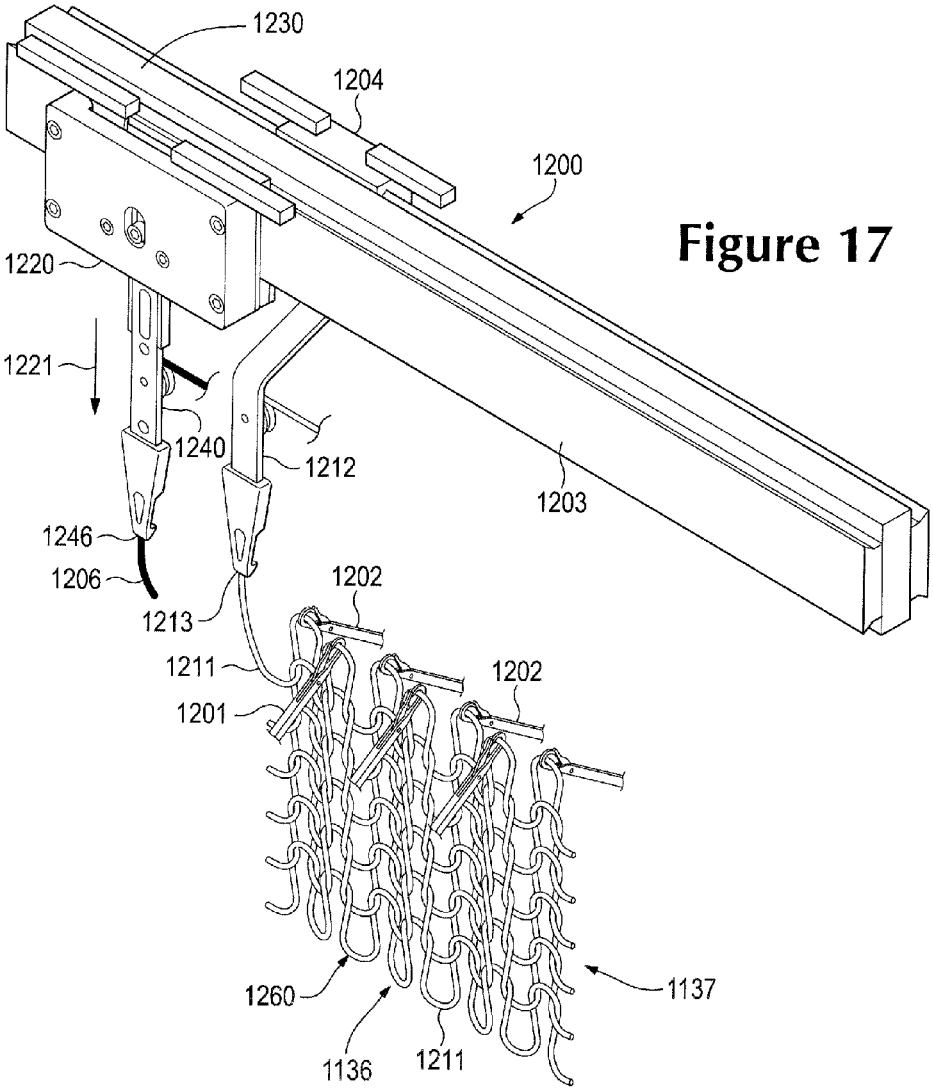

Continuing with the knitting process, feeder arm 1240 now translates from the retracted position to the extended position, as depicted in FIG. 17. In the extended position, feeder arm 1240 extends downward from carrier 1230 to position dispensing tip 1246 in a location that is (a) centered between needles 1202 and (b) below the intersection of needle beds.

Figure 18:
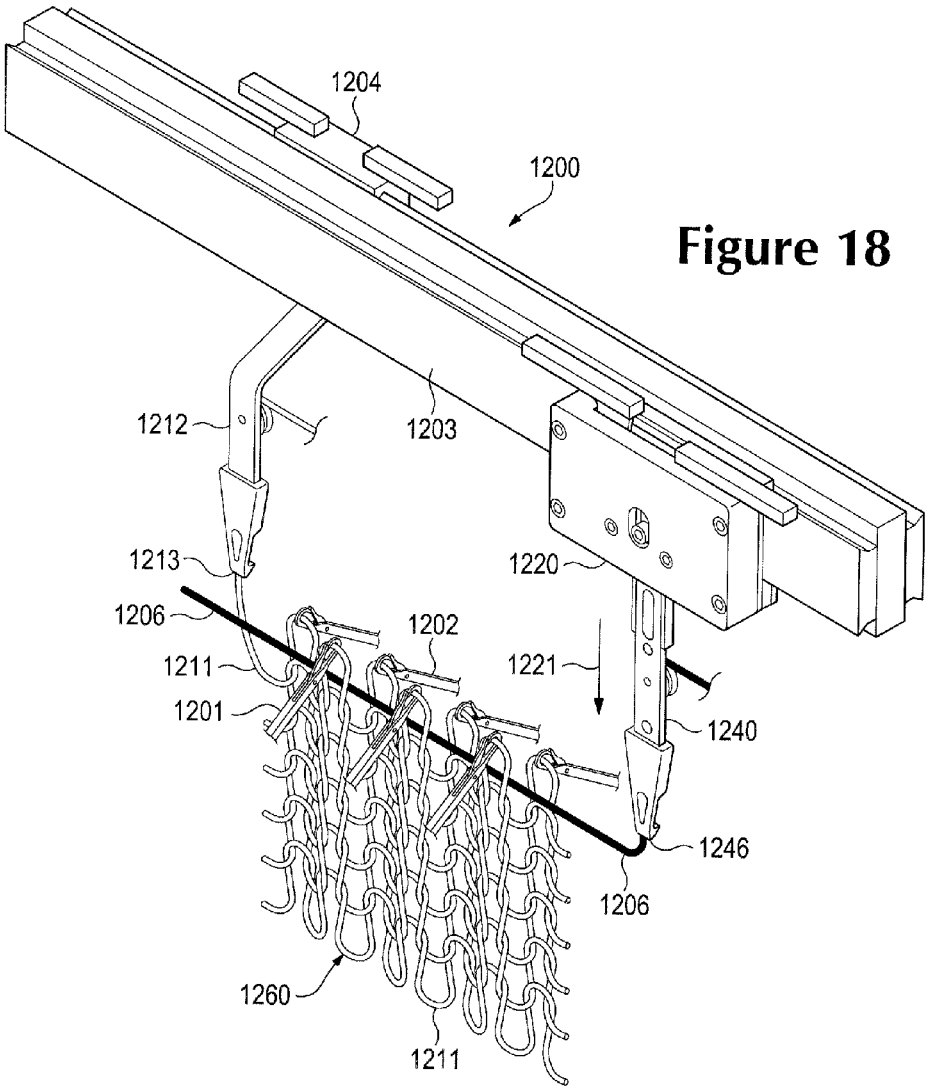

Referring now to FIG. 18, combination feeder 1220 moves along rail 1203 and yarn 1206 is placed between loops of knitted component 1260. That is, yarn 1206 is located in front of some loops and behind other loops in an alternating pattern. Moreover, yarn 1206 is placed in front of loops being held by needles 1202 from one needle bed 1201, and yarn 1206 is placed behind loops being held by needles 1202 from the other needle bed. Note that feeder arm 1240 remains in the extended position in order to inlay yarn 1206 in the area below the intersection of needle beds. This effectively places yarn 1206 within the course recently formed by standard feeder 1204 in FIG. 16.

Figure 19:
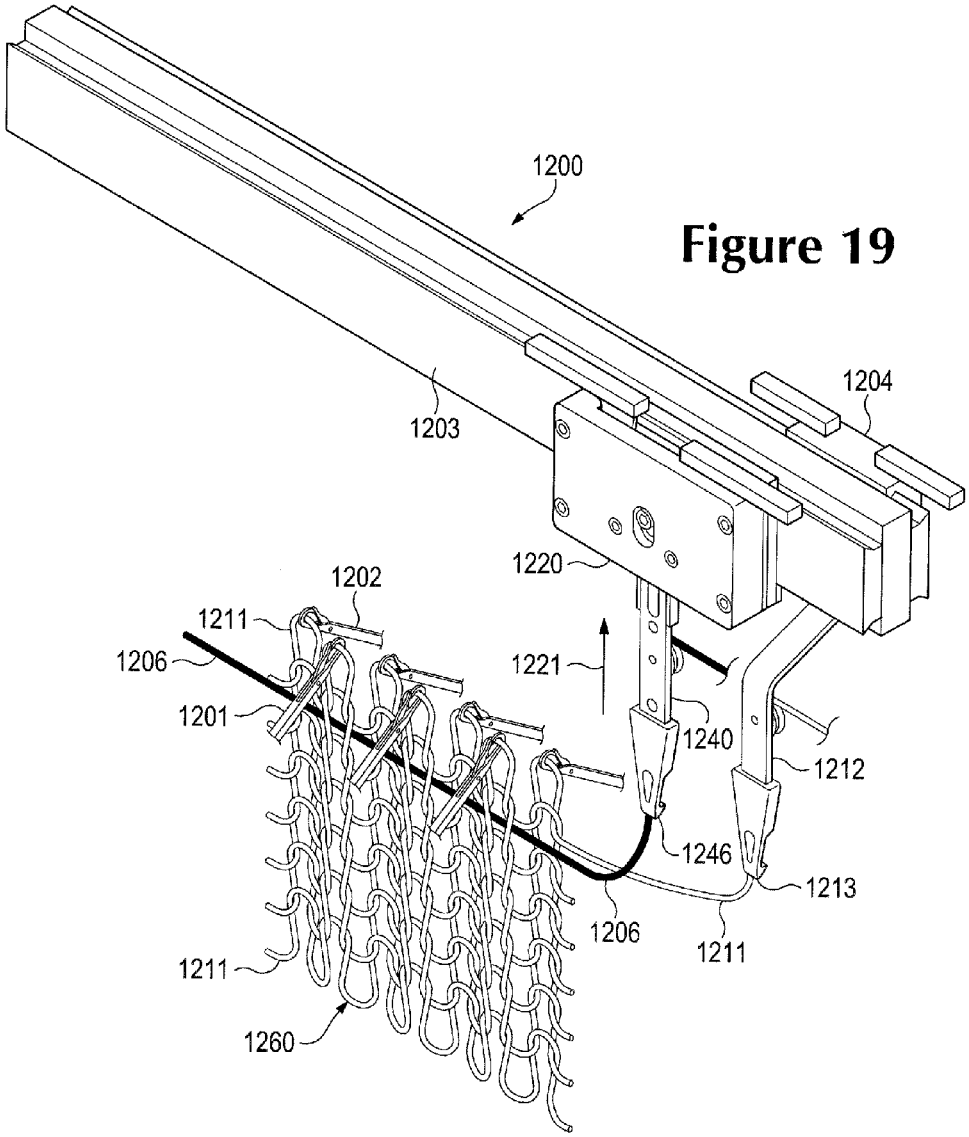

In order to complete inlaying yarn 1206 into knitted component 1260, standard feeder 1204 moves along rail 1203 to form a new course from yarn 1211, as depicted in FIG. 19. By forming the new course, yarn 1206 is effectively knit within or otherwise integrated into the structure of knitted component 1260. At this stage, feeder arm 1240 may also translate from the extended position to the retracted position.

FIGS. 18 and 19 show separate movements of feeders 1204 and 1220 along rail 1203. That is, FIG. 18 shows a first movement of combination feeder 1220 along rail 1203, and FIG. 19 shows a second and subsequent movement of standard feeder 1204 along rail 1203. In many knitting processes, feeders 1204 and 1220 may effectively move simultaneously to inlay yarn 1206 and form a new course from yarn 1211. Combination feeder 1220, however, moves ahead or in front of standard feeder 1204 in order to position yarn 1206 prior to the formation of the new course from yarn 1211.

The general knitting process outlined in the above discussion provides an example of the manner in which strand 158 of FIGS. 1-6 may be located in the base portion 124, the lateral portion 130, and/or the medial portion 132 of the upper 120. More particularly, because of the reciprocating action of feeder arm 1240, the strand 158 may be located within a previously formed course prior to the formation of a new course.

Figure 20:
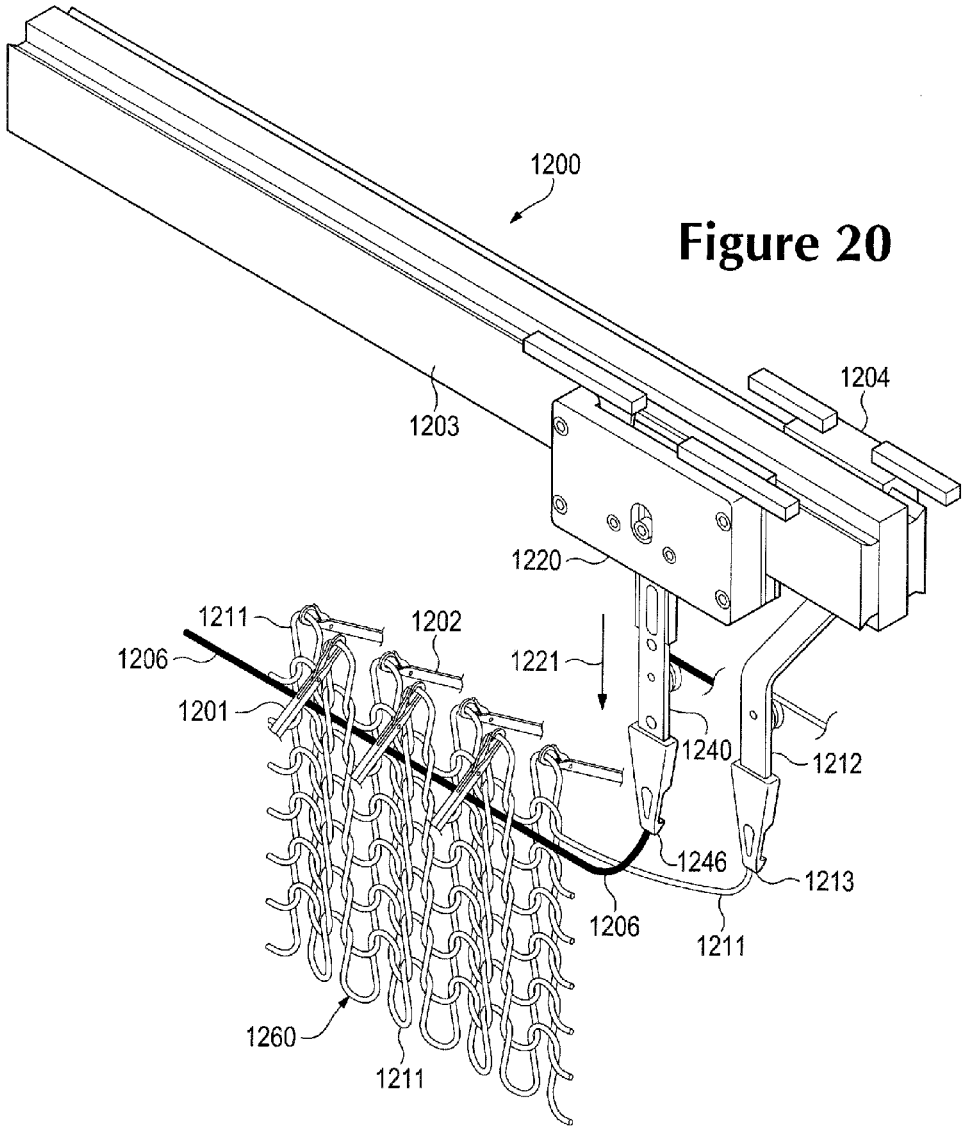
Figure 21:
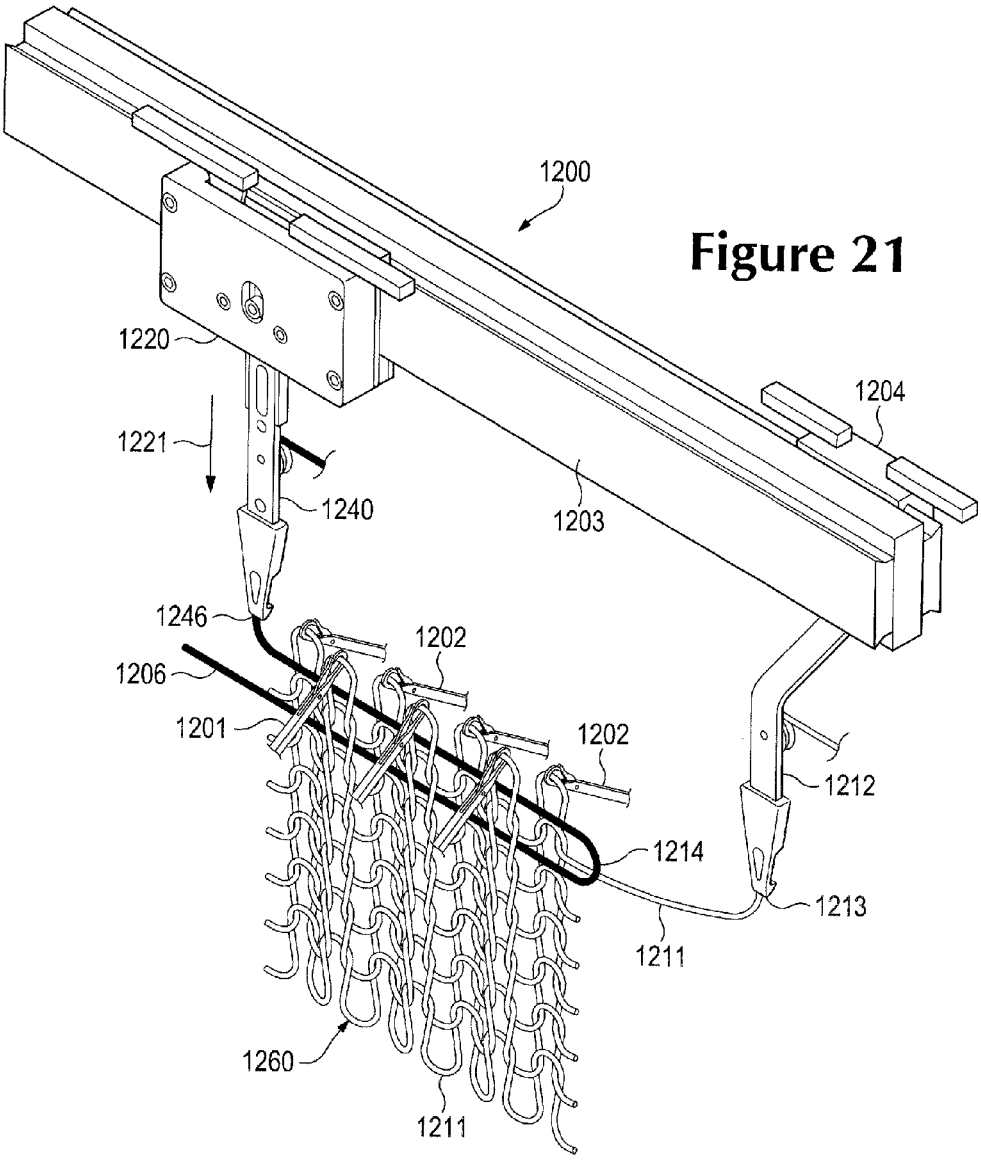
Figure 22:
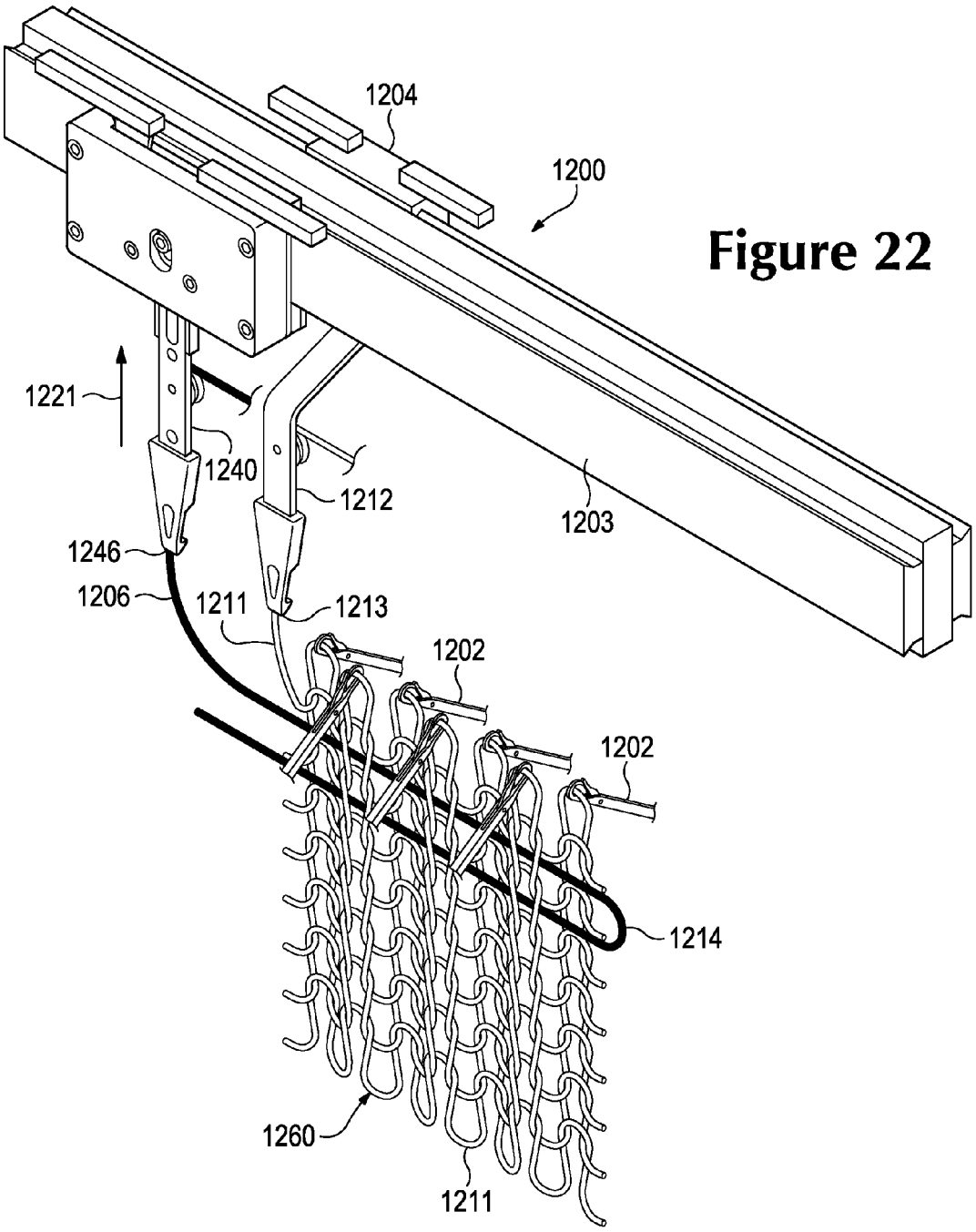

Continuing with the knitting process, feeder arm 1240 now translates from the retracted position to the extended position, as depicted in FIG. 20. Combination feeder 1220 then moves along rail 1203 and yarn 1206 is placed between loops of knitted component 1260, as depicted in FIG. 21. This effectively places yarn 1206 within the course formed by standard feeder 1204 in FIG. 19. In order to complete inlaying yarn 1206 into knitted component 1260, standard feeder 1204 moves along rail 1203 to form a new course from yarn 1211, as depicted in FIG. 22. By forming the new course, yarn 1206 is effectively knit within or otherwise integrated into the structure of knitted component 1260. At this stage, feeder arm 1240 may also translate from the extended position to the retracted position.

Referring to FIG. 22, yarn 1206 forms a loop 1214 between the two inlaid sections. In the discussion of the turns 159, 160 of FIGS. 1-6, it was noted that strand 158 exits the passage 162 and then enters another passage 162, thereby forming the turns 159, 160. Loop 1214 can be formed in a similar manner. That is, loop 1214 can be formed where yarn 1206 exits the knit structure of knitted component 1260 and then re-enters the knit structure.

Figure 23:
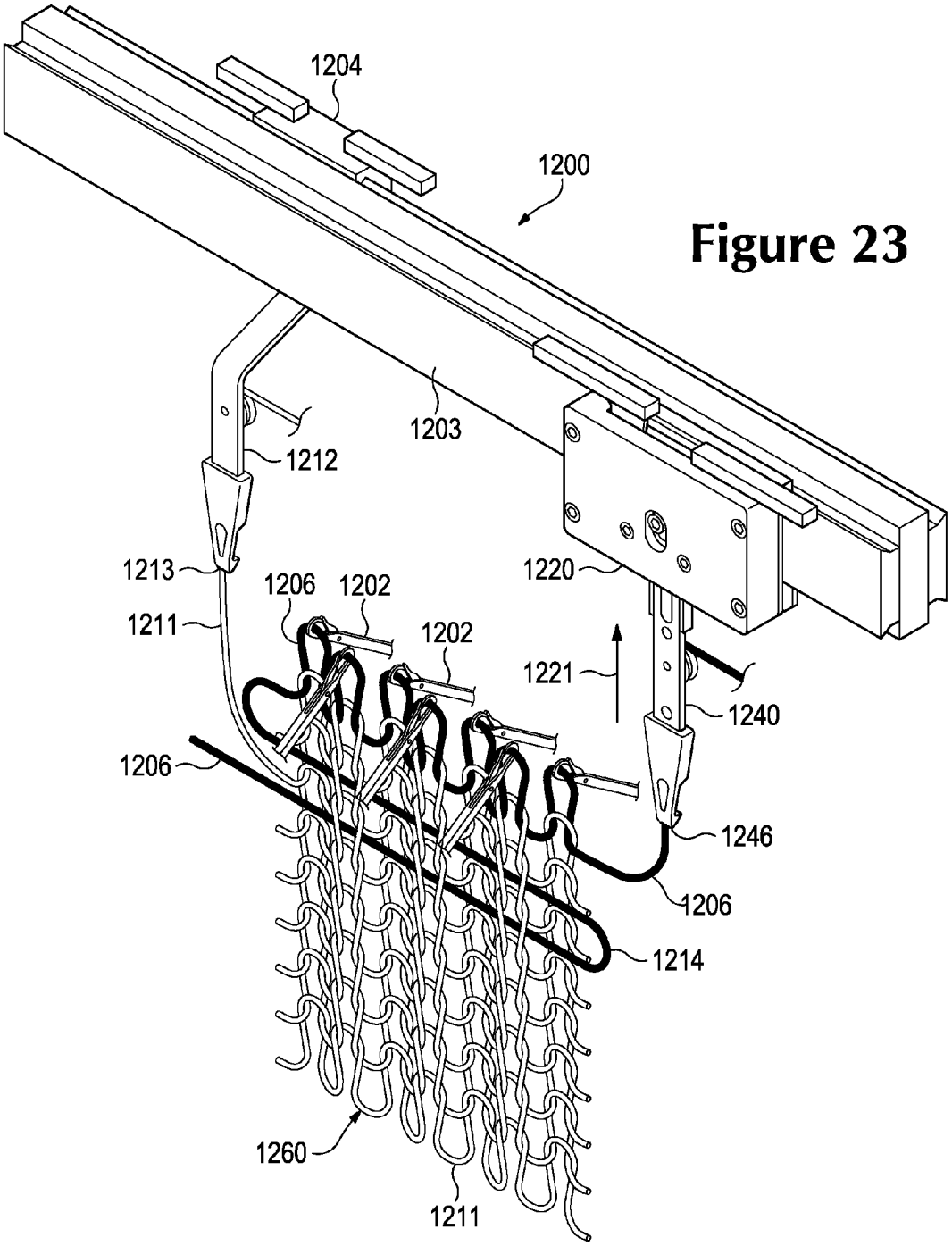

Referring to FIG. 23, combination feeder 1220 moves along rail 1203 while in the retracted position and forms a course of knitted component 1260 while in the retracted position. Accordingly, by reciprocating feeder arm 1240 between the retracted position and the extended position, combination feeder 1220 may supply yarn 1206 for purposes of knitting, tucking, floating, and inlaying.

The following discussion and accompanying figures disclose a variety of concepts relating to knitted components and the manufacture of knitted components. Although the knitted components may be utilized in a variety of products, an article of footwear that incorporates one of the knitted components is disclosed below as an example.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An upper for an article of footwear that is configured to be connected to a sole structure and configured to receive a foot, the upper comprising: a knitted component comprising a one-piece unit of unitary knit construction and comprising: a base portion configured to be disposed adjacent the sole structure, a heel portion and a forefoot portion that extend from opposite ends of the base portion when in an unassembled configuration, a medial portion and a lateral portion that extend from opposite sides of the base portion when in an unassembled configuration, the medial and lateral portion cooperating to define a throat area between the medial and lateral portions, and a tongue portion that is configured to be disposed in the throat area, the tongue portion decoupled from at least one of the medial portion and the lateral portion and extending from the base portion; a first edge of the knitted component; and a second edge of the knitted component configured to be abbutingly coupled to the first edge at a seam causing the base portion, the heel portion, the forefoot portion, the medial portion, the lateral portion and the tongue portion to cooperatively define a void that is configured to receive the foot, wherein the seam is the only seam of the upper.

2. The upper of claim 1, wherein the heel portion and base portion cooperate to define a surface of a heel cavity having three dimensional curvature.

3. The upper of claim 1, wherein the forefoot portion and base portion cooperate to define a surface of a forefoot cavity having three dimensional curvature.

4. The upper of claim 1, wherein a gap is defined between the forefoot portion and one of the medial and lateral portions, the tongue portion extending from the base portion and disposed within the gap.

5. The upper of claim 1, wherein the knitted component includes a first tapered area with a first tapered boundary and a second tapered area with a second tapered boundary, the first tapered boundary joined to the second tapered boundary to provide the knitted component with a three dimensionally contoured surface.

6. The upper of claim 1, wherein the tongue portion includes a curved region having a plurality of knit courses that radiate from a common area to provide the curved region with curvature.

7. The upper of claim 1, further comprising a tensile strand that is incorporated in the unitary knit construction, the tensile strand extending across at least one of the base portion, the medial portion, and the lateral portion.

8. The upper of claim 7, wherein the tensile strand extends continuously between the base portion and one of the medial portion and the lateral portion.

9. The upper of claim 8, wherein the tensile strand extends continuously from the medial portion, through the base portion, to the lateral portion.

10. The upper of claim 9, wherein the tensile strand alternatingly extends between the medial portion and the lateral portion, the tensile strand extending through the base portion as the tensile strand alternates between the medial portion and the lateral portion.

11. The upper of claim 7, wherein the tensile strand includes a turn configured to receive and support a closure element that selectively secures the upper to the foot.

12. The upper of claim 11, wherein one of the medial portion and the lateral portion includes an opening and the turn extends at least partially around the opening, the, opening and the turn configured to cooperatively receive and support the closure element.

13. The upper of claim 12, wherein the turn is exposed from the one of the medial portion and the lateral portion.

14. The upper of claim 12, wherein the turn is enclosed between an exterior surface and an interior surface of the one of the medial portion and the lateral portion.

15. The upper of claim 7, wherein the base portion defines an interior surface of the knitted component and an exterior surface of the knitted component, a passage being defined between the interior surface and the exterior surface, and wherein the tensile strand extends through the passage.

16. The upper of claim 15, wherein a first longitudinal portion of the tensile strand is disposed inside the passage and a second longitudinal portion of the tensile strand is exposed from the passage.

17. The upper of claim 1, wherein the first edge and the second edge are coupled at the seam by at least one of stitching, bonding, welding, fasteners, tape and adhesives.

18. The upper of claim 1, wherein the seam includes stitching that is independent of stitching of the unitary knit construction.

19. The upper of claim 18, wherein the seam extends continuously from the base portion to at least one of the medial portion, the lateral portion, and the forefoot portion.

20. The upper of claim 19, wherein the seam is spaced from the heel portion such that the heel portion is seamless.

* * * * *